US005478967A

United States Patent [19]

Saito et al.

[11] Patent Number: 5,478,967

[45] Date of Patent: Dec. 26, 1995

[54] AUTOMATIC PERFORMING SYSTEM FOR REPEATING AND PERFORMING AN ACCOMPANIMENT PATTERN

[75] Inventors: Tsutomu Saito; Masahiko Yamada, both of Shizuoka; Haruo Minoura; Hironobu Nakagawa, both of Hamamatsu, all of Japan

[73] Assignee: Kabushiki Kaisha Kawai Gakki Seisakusho, Japan

[21] Appl. No.: 215,927

[22] Filed: Mar. 22, 1994

[30] Foreign Application Priority Data

Mar. 30, 1993 [JP] Japan ..... 5-072365
Mar. 30, 1993 [JP] Japan ..... 5-072366

[51] Int. Cl.[6] ..... G10H 1/38; G10H 1/40; G10H 1/46

[52] U.S. Cl. ..... 84/612; 84/613; 84/633; 84/DIG. 12; 84/DIG. 22

[58] Field of Search ..... 84/609–614, 633–638, 84/649–652, 665–669, DIG. 12, DIG. 22, 477 R, 478

[56] References Cited

U.S. PATENT DOCUMENTS 4,905,561 3/1990 Mizuno ..... 84/613
5,153,361 10/1992 Kozuki ..... 84/613
5,179,241 1/1993 Okuda et al. ..... 84/613
5,239,124 8/1993 Eitaki et al. ..... 84/634
5,262,584 11/1993 Shimada ..... 84/609
5,278,348 1/1994 Eitaki et al. ..... 84/636

FOREIGN PATENT DOCUMENTS 63-193200 8/1988 Japan .

*Primary Examiner*—Stanley J. Witkowski
*Attorney, Agent, or Firm*—Davis, Bujold & Streck

[57] ABSTRACT

In an automatic performing system, when the track is changed to one having a different loop bar number, the bar to be reproduced next is easily determined by first dividing the number of bars accumulated from the start of accompaniment by the loop bar number stored in the sequence track. Based on the remainder resulting from the division, the number of beats is determined and the present pointer is set. In the automatic performing system, by comparing the data at the next address with the part designation data, it is determined whether the read out data belongs to the designated part or not. Therefore, the accompaniment data corresponding to the designated part data can be read out and reproduced.

6 Claims, 24 Drawing Sheets

FIG. 5B

RHYTHM:

```
     0      1     2    3
 0: 0FDH,003H,000H,064H ; start bar mark
 1: 000H,064H,000H,0EEH ;   common note(64H)
 2: 030H,026H,000H,0EEH ;   common note(26H)
 3: 060H,026H,000H,0EEH ;   common note(26H)
 4: 0FFH,000H,000H,064H ; end bar mark
```

BASS:

```
     0      1     2    3
 0: 0FDH,002H,023H,078H ; start bar mark
 1: 000H,024H,017H,05EH ;   major note(24H)
 2: 000H,024H,018H,0A7H ;   minor note(24H)
 3: 0FEH,002H,023H,078H ; 2nd bar mark
 4: 000H,02BH,017H,05FH ;   major note(2BH)
 5: 000H,02AH,017H,0A4H ;   minor note(2AH)
 6: 0FFH,000H,023H,078H ; end bar mark
```

ARPEGGIO:

```
     0      1     2    3
 0: 0FDH,000H,044H,06EH ; start bar mark
 1: 0FEH,000H,044H,06EH ; 2nd bar mark
 2: 0FEH,004H,044H,06EH ; 3rd bar mark
 3: 030H,04CH,006H,06BH ;   major note(4CH)
 4: 030H,04BH,006H,0ABH ;   minor note(4BH)
 5: 048H,04DH,006H,0E4H ;   common note(4DH)
 6: 060H,04FH,006H,0E8H ;   common note(4FH)
 7: 0FEH,004H,044H,06EH ; 4th bar mark
 8: 000H,054H,006H,0E4H ;   common note(54H)
 9: 030H,04FH,006H,0E4H ;   common note(4FH)
 A: 060H,04CH,006H,064H ;   major note(4CH)
 B: 060H,04BH,006H,0A4H ;   minor note(4BH)
 C: 0FFH,000H,044H,06EH ; end bar mark
```

FIG. 7A

| | 7 | 6 | 5 | 4 | 3 | 2 | 1 | 0 | |
|---|---|---|---|---|---|---|---|---|---|
| 0 | STEP TIME | | | | | | | | 0~181 |
| 1 | 0 | NOTE | | | | | | | |
| 2 | GATE TIME | | | | | | | | |
| 3 | PB | PA | VELOCITY | | | | | | |

FIG. 7B

| | 7 | 6 | 5 | 4 | 3 | 2 | 1 | 0 | |
|---|---|---|---|---|---|---|---|---|---|
| 0 | STEP TIME | | | | | | | | 0~181 |
| 1 | 1 0 0 0 | | | | ----- | | | | |
| 2 | GATE TIME | | | | | | | | |
| 3 | L7 | L6 | L5 | L4 | L3 | L2 | L1 | L0 | |

FIG. 7C

| | 7 | 6 | 5 | 4 | 3 | 2 | 1 | 0 | |
|---|---|---|---|---|---|---|---|---|---|
| 0 | STEP TIME | | | | | | | | 0~181 |
| 1 | 1 0 0 1 | | | | ----- | | | | |
| 2 | ---------- | | | | | | | | |
| 3 | TONE No. | | | | | | | | |

FIG. 7D

| | 7 | 6 | 5 | 4 | 3 | 2 | 1 | 0 | |
|---|---|---|---|---|---|---|---|---|---|
| 0 | STEP TIME | | | | | | | | 0~181 |
| 1 | 1 0 1 0 | | | | ------- | | | | |
| 2 | ---------- | | | | | | | | |
| 3 | VOLUME | | | | | | | | |

FIG. 7E

| | 7 | 6 | 5 | 4 | 3 | 2 | 1 | 0 | |
|---|---|---|---|---|---|---|---|---|---|
| 0 | STEP TIME | | | | | | | | 0~181 |
| 1 | 1 0 1 1 | | | | ----- | | | V | |
| 2 | BEND(PART A) | | | | | | | | |
| 3 | BEND(PART B) | | | | | | | | |

FIG. 7F

| | 7 | 6 | 5 | 4 | 3 | 2 | 1 | 0 | |
|---|---|---|---|---|---|---|---|---|---|
| 0 | 1 | 1 | 1 | 1 | 1 | 1 | * | * | 253, 254, 255 |
| 1 | EVENT | | | | VALUE | | | | |
| 2 | TONE No. | | | | | | | | |
| 3 | VOLUME | | | | | | | | |

AUTOMATIC PERFORMING SYSTEM FOR REPEATING AND PERFORMING AN ACCOMPANIMENT PATTERN

FIELD OF THE INVENTION

This invention relates to an automatic performing system which automatically repeats the accompaniment part in specified loop bars, and also relates to a system which automatically performs based on the accompaniment pattern stored according to a group of chord types.

BACKGROUND OF THE INVENTION

In a conventionally known electronic organ, electronic piano or other automatic performing apparatus, the accompaniment pattern is stored for every chord type, such as major, minor and seventh chords. In response to the depression of keys, the chord type is determined and the accompaniment pattern corresponding to that chord type is selected. Sound is generated according to the selected accompaniment pattern.

In an automatic performing apparatus, an automatic accompaniment function is provided, such that the accompaniment part of rhythm, bass and arpeggio data is automatically reproduced.

For the automatic accompaniment, rhythm, bass and arpeggio data for the same number of bars are stored in an automatic accompaniment memory. Specifically, as shown in FIG. 18, sound tone and generating timing for each accompaniment part are mixedly stored in one sequence track of rhythm R, bass B and arpeggio A.

The sequence track of the automatic accompaniment memory shown in FIG. 18 is accessible with only one pointer, because rhythm R, bass B and arpeggio A are stored together. However, the data for the least common multiple of looped bars among rhythm R, bass B and arpeggio A needs to be stored.

For example, if two bars of rhythm R, four bars of bass B and one bar of arpeggio A are required in a loop, an accompaniment part consisting of four bars needs to be stored. The data shown by the slashed lines in FIG. 18 are overlapped in the same loop. For example, the data A2, A3 and A4 have the content identical to that of data A1. The automatic accompaniment memory is thus inefficiently used.

Recently, as the quality of musical performance has been enhanced, the number of bars in a loop have increased. Wasted memory remains a problem.

To efficiently use the accompaniment memory, a track may be provided for each accompaniment part, such that the bars in a loop are stored and reproduced. If rhythm style is changed halfway through the accompaniment, however, the bar at which the new rhythm style is to be started in each accompaniment part cannot be identified.

The aforementioned problem is especially prevalent in the electronic organ, since if the rhythm style is changed, the accompaniment is continued from the bar of the new rhythm style corresponding to the bar which was played before the rhythm style had been changed.

Also, in conventionally known electronic organs, electronic pianos, or other automatic performing apparatus, the automatic accompaniment function is provided, such that the accompaniment part is performed based on the accompaniment pattern stored for each chord type.

The accompaniment patterns corresponding to each chord type are stored. In response to the depressing of keys, the particular chord type is determined. According to the accompaniment pattern corresponding to the determined chord type, sound is generated.

To conserve and efficiently use the memory of the automatic performing system, Japanese Laid-open Patent Application No. 63-193200 proposes the storing of the accompaniment pattern for each chord type group. The chord types are divided into major and minor mode groups.

In this method, the accompaniment patterns corresponding to each chord type group are stored. In response to the depression of keys, the particular chord type is detected, the chord type group containing the detected chord type is located, the accompaniment pattern corresponding to the located chord type group is selected, and sound is generated according to the accompaniment pattern.

The prior art, however, contains disadvantages. Usually, the accompaniment patterns are stored in different sequence tracks or areas. As aforementioned, when the accompaniment pattern for each chord type group is stored in response to the player's depressing of keys, a data reading pointer should jump to the accompaniment pattern corresponding to the desired chord type group. Alternatively, respective pointers for each chord type group should work coincidentally. The processing in the CPU is complicated, and unwanted delay in performance may arise.

Also, the accompaniment pattern for each chord type group is stored in a different sequence track, thus, even if the accompaniment patterns are partly the same, they have to be independently stored. Furthermore, every sequence track requires a bar marking, thereby increasing the volume of accompaniment pattern memory.

SUMMARY OF THE INVENTION

Wherefore, an object of this invention is to provide an automatic performing system which can efficiently use the automatic performing memory and can continuously reproduce accompaniment parts smoothly even if rhythm or some other style is changed.

Another object of this invention is to provide an automatic performing system which can alleviate the load on CPU and perform without delay while efficiently using the memory for storing accompaniment patterns.

To attain these or other objects, the present invention provides an automatic performing system comprising a performance data memory M1 for storing a plurality of performance data loops having a varied number of bars in different loops, hereafter loop bar number, a loop performer M2 for repeatedly reading the plurality performance data loops stored in the performance data memory M1 and performing it, a bar number counter M3 for accumulating the number of bars performed, accumulated bar number, from the beginning of the performance of the loop performer M2, and a reproduction indicator M4 for dividing the number of bars accumulated by the bar numbers counter M3 by the number of bars in the loop being performed and indicating the bar to be reproduced in the now performance data loop to be performed based on the remainder resulting from the division.

In this automatic performing system, the loop bars number is represented as a number to the power of 2, and, by masking the specified bit of the accumulated bar number represented in binary number, the bar to be reproduced is indicated.

The automatic performing system may include an electronic organ, an electronic piano and an electronic keyboard.

The present invention can be used when the signals entered from a keyboard using MIDI are processed with a personal computer or other universal computer for automatic performance.

The varied data loops having different loop bar numbers stored in the performance data memory M1 means at least two different loops with different loop bar numbers may be stored. The loop numbers are not varied.

If the plurality performance data loops are stored in corresponding tracks, the memory can be saved, as opposed to the prior-art in which the plural performance data for the same loop bars are stored in corresponding tracks. Further, since unnecessary performance data is not read, the CPU can efficiently process the data. In the prior art, the performance data consisting of plural parts is stored in one track, and the parts other than the required part are unnecessarily read. Alternatively, in the present invention the plural performance data loops, having the varied loop bar numbers can be stored in one track, thereby saving more memory. However, the performance data of the bar different from the bar to be played at the present moment has to be abandoned, even if it is read out. Therefore, when reading out the performance data, time is wasted in the CPU to abandon unnecessary performance data.

The most efficient manner of using memory and operating the CPU is to store an amount of the performance data loops having the same loop bar number in one track and provide a plurality of memory tracks, one for each loop bar number. Therefore, pointers are required only for each track, not for each data loop. Also, all of stored performance data of the same loop bar number require only one bar marking for each bar.

When an amount of performance data is read out, rhythm, bass and arpeggio are usually read out coincidentally. Specifically, performance data is read out coincidentally with a pointer. The time-division processing in the CPU can be in the range of such coincidence.

In the reproduction indicator M4 for indicating the bar to be reproduced, the accumulated bar number can be actually divided by the loop bar number varied according to the performance data. Alternatively, the bar number to be read out can be indicated by referring to the table in which the remainder resulting from the division is stored corresponding to the accumulated bar number and the loop bar number.

The masking of the specified bit, for example, the upper bit of the accumulated bar number represented in binary number, is carried out by extracting the logical product with an AND operation from the 8-bit binary counter of accumulated bar number and the 8-bit binary data established for masking.

In operation, the plural performance data loops having varied loop bar numbers are stored in the performance data memory M1, and are repeatedly read out for performance by the loop performer M2. Subsequently, the accumulated number of bars performed is counted by the bar number counter M3 from the beginning of the performance. In the reproduction indicator M4 the accumulated bar number is divided by the loop bar number and the bar to be reproduced is indicated based on the remainder resulting from the division.

Thus, the remainder from the division of the accumulated bar number by the respective different loop bar number indicates the position of the bar to be reproduced. Even if the loop bar number is varied, the bar to be reproduced can be promptly designated. Therefore, if the rhythm style is changed halfway or some part is reproduced from the halfway point, the performance can smoothly continue.

The loop bar number to be stored can be varied according to each rhythm style or each track, and the minimum loop bar number can be established. Thus, without deteriorating the quality of performance, the memory can be reduced.

Each loop bar number is represented as a number to the power of 2. By masking the specified bit of the accumulated bar number represented in binary form, the bar to be reproduced can be located easily.

The procedure for masking to select the bar number to be reproduced or read out is now explained.

The accumulated bar number displayed in a decimal number on a panel has a correlation with the bar number accumulated and stored in binary form by the bar counter as shown in the following Table 1.

TABLE 1

| THE ACCUMULATED BAR NUMBER DISPLAYED ON THE PANEL DECIMAL - 3 DIGITS | BAR COUNTER BINARY - 8 DIGITS |
|---|---|
| 001ST BAR | 00000000 |
| 002ND BAR | 00000001 |
| ... | ... |
| 014TH BAR | 00001101 |
| ... | ... |
| 030TH BAR | 00011101 |
| ... | ... |
| 099TH BAR | 01100101 |
| 100TH BAR | 01100110 |
| ... | ... |
| 256TH BAR | 11111111 |

When the loop bar number is established as a number to the power of 2, the mask data for determining the bar number to be read out are established as in Table 2.

TABLE 2

| MASK DATA | | | | | | | | LOOP BAR |
|---|---|---|---|---|---|---|---|---|
| 0 | 0 | 0 | 0 | M3 | M2 | M1 | M0 | NUMBER |
| 0 | 0 | 0 | 0 | 0 | 0 | 0 | 0 | 1 BAR LOOP |
| 0 | 0 | 0 | 0 | 0 | 0 | 0 | 1 | 2 BAR LOOP |
| 0 | 0 | 0 | 0 | 0 | 0 | 1 | 1 | 4 BAR LOOP |
| 0 | 0 | 0 | 0 | 0 | 1 | 1 | 1 | 8 BAR LOOP |
| 0 | 0 | 0 | 0 | 1 | 1 | 1 | 1 | 16 BAR LOOP |

The bar to be reproduced next in each accompaniment part is obtained as the logical product of the bar counter prepared in response to timer interruption and the mask data.

For example, in the accompaniment of four bars in a loop, when the panel displays the accumulated bar number of the 30th bar, the bar counter counts 00011101b. The AND operation using number 00011101b of the bar counter and number 00000011b of the four bar loop results in number 00000001b, which indicates the second bar is being performed. If the accompaniment is changed, for example, to the style of 16 bars in a loop by operating a rhythm style changing switch, the AND operation using number 00011101b of the bar counter and number 00001111b of the 16 bar loop results in number 00001101b, which indicates the 14th bar. Thus, sound can be reproduced halfway from the 14th bar.

By masking the bar counter according to the loop bar number, the bar to be reproduced corresponding to the loop bar number can be quickly obtained.

The present invention further provides an automatic performing system comprising a chord type detector M101 for detecting the chord type in response to the depression of keys, an accompaniment data memory M102 for adding the chord type group identification data to the accompaniment data corresponding to the respective chord type groups and storing the accompaniment data into one sequence track, a group identifying unit M103 for identifying to which chord type group the chord type detected by the chord type detector M101 belongs, and an accompaniment data reading unit M104 for selectively reading out the accompaniment data corresponding to the chord type group identified by the group identifying unit M103 from the accompaniment data memory M102 using the identification data.

In the automatic performing system of the present invention, when at least two chord type groups have the same accompaniment data, the identification data indicates the same accompaniment data for each of the chord type groups.

In operation, in response to the depression of keys, the chord type is detected by the chord type detector M101, and the cord type group to which chord type group the detected chord type belongs is identified by the group identifying unit M103. The accompaniment data corresponding to the identified chord type group are selectively read out by the accompaniment data reading unit M104 from the accompaniment data memory M102 using the identification data.

In the accompaniment data memory M102, the accompaniment data corresponding to the respective chord type groups with the identification data for identifying the chord type group added thereto are stored in one sequence track. According to the identified chord type group the identification data is detected, and the accompaniment data indicated by the identification data is used for accompaniment.

Thus, the memory for storing the accompaniment data can be reduced. The accompaniment data can be detected with only one pointer. Even if different keys are depressed, the pointer can stay in the same track. Therefore, the processing of the CPU is reduced and no unwanted delay occurs during the music performance.

In the automatic performing system the identification data is provided for indicating that at least two chord type groups have the identical accompaniment data among the accompaniment data corresponding to the plural chord type groups. Even if different chord type groups use the same accompaniment data, only the accompaniment data common to the chord type groups can be stored because of the provision of the identification data, thereby reducing the memory for storing the accompaniment data.

BRIEF DESCRIPTION OF THE DRAWINGS

FIGS. 5A and 5B are explanatory views showing the structure of bars in each loop of data.

FIGS. 7A through 7E are explanatory views of the note data, LED indication data, tone data, volume data, and auto-bend data, respectively, in the accompaniment data, and FIG. 7F is an explanatory view of bar marking.

DETAILED DESCRIPTION OF THE PREFERRED EMBODIMENT

An embodiment of the present invention is explained hereunder although it is understood that other embodiments are within the scope of the present invention.

Figure 1A:
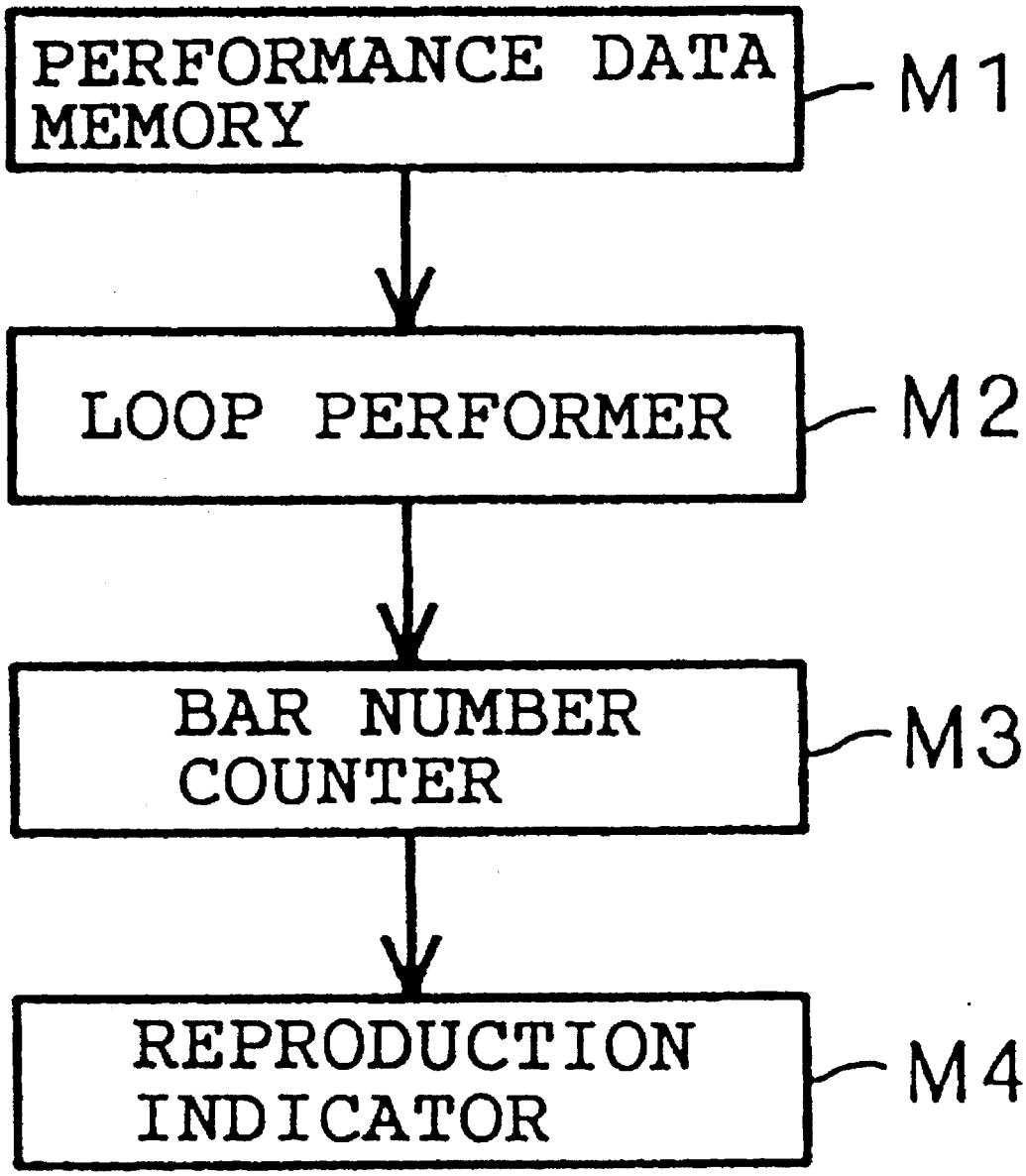
FIGS. 1A and 1B are schematic diagrams illustrating the structure of the invention.
Figure 1B:
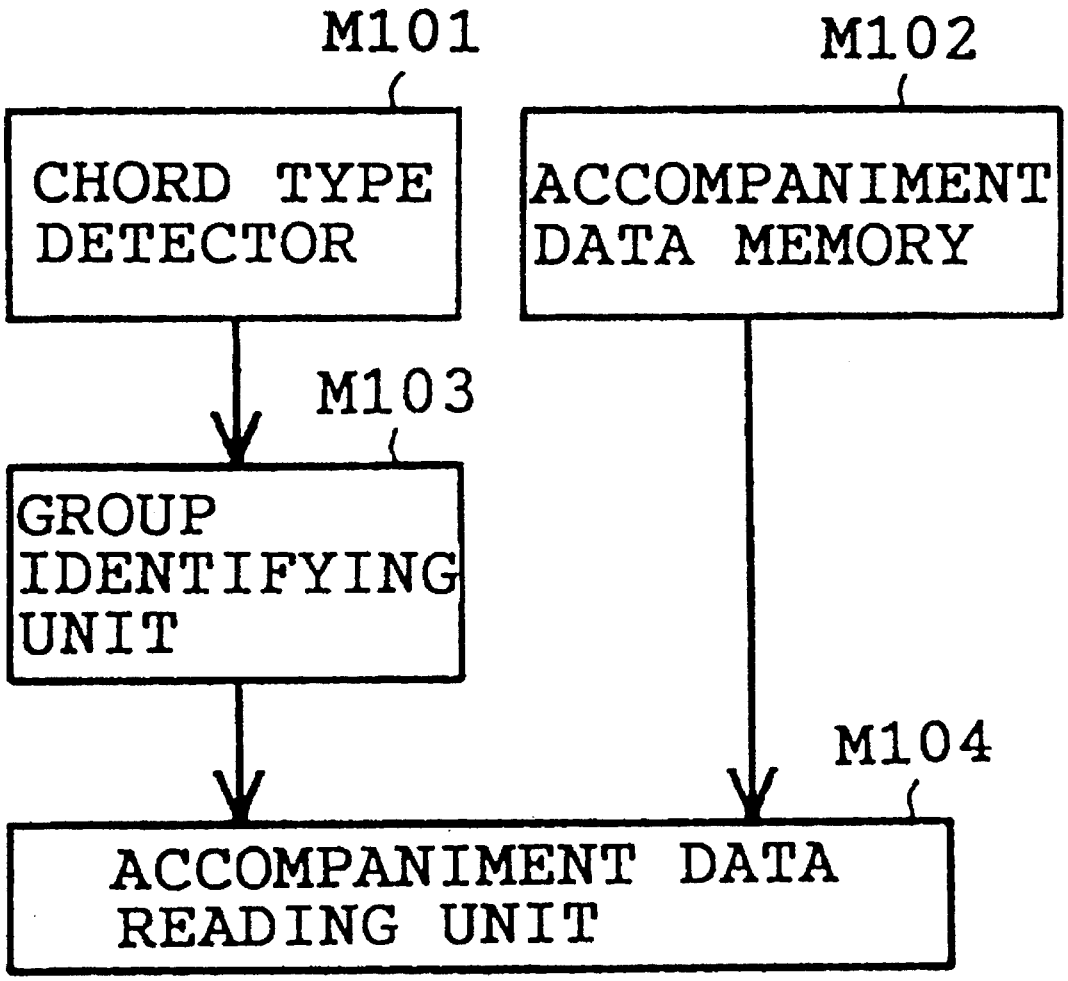
Figure 2:
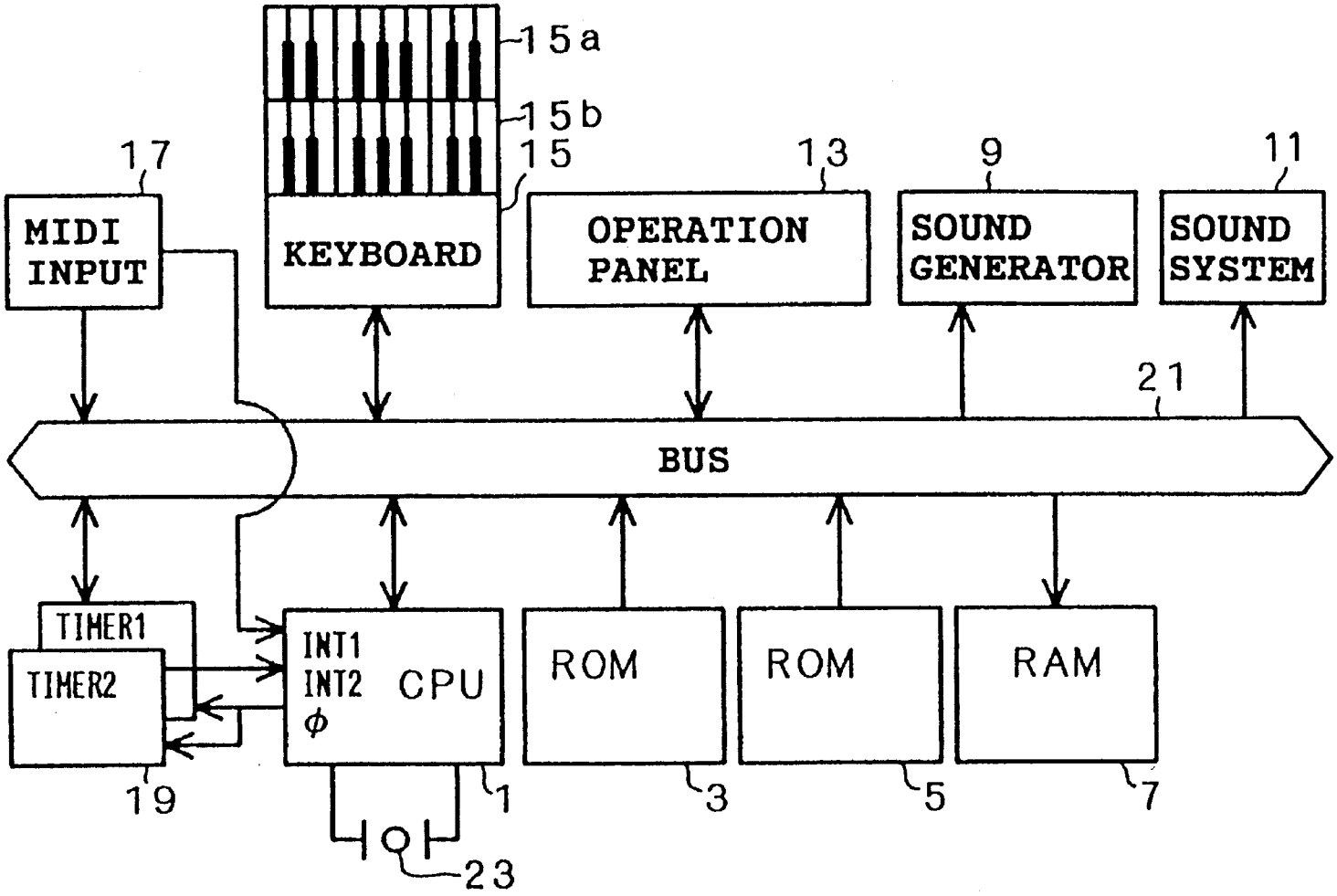
FIG. 2 is a block diagram showing the electric structure of an electronic organ embodying the invention.

An electronic organ embodying the automatic performing system of the present invention is provided with a keyboard, as shown in FIG. 2. The electronic organ, CPU 1, ROM 3, ROM 5, RAM 7, sound generator 9, sound system 11, operation panel 13, keyboard 15, MIDI input 17 and timers 19 are connected via a bus 21 to one another.

In CPU 1, the tempo frequencies, the accompaniment data according to the established tempo, and other data are processed. An externally provided crystal resonator 23 puts CPU 11 into oscillation. The clock signals obtained by dividing oscillations are sent to the timers 19.

Each control program is stored in ROM 3 for the computation executed by CPU 1.

The automatic accompaniment data, such as part 1 of rhythm, part 2 of bass and part 3 of arpeggio (abbreviated hereunder as ARP), are stored for eight rhythm styles including waltz and swing in ROM 5. Each of the automatic accompaniment data consists of four patterns: introduction, fill-in, main and ending.

RAM 7 provides the data to be processed by CPU 1, and RAM 7 is partly formed as registers described later and shown in FIG. 9.

The sound generator 9 generates sound at a time division of 32 channels. Among these channels, 16 channels are used for manual performance and the other 16 channels are used for automatic accompaniment.

The sound system 11 converts the digital signals sent from the sound generator 9 to analog signals, and amplifies the analog signals. Sound is played by a not-shown loudspeaker.

Figure 3:
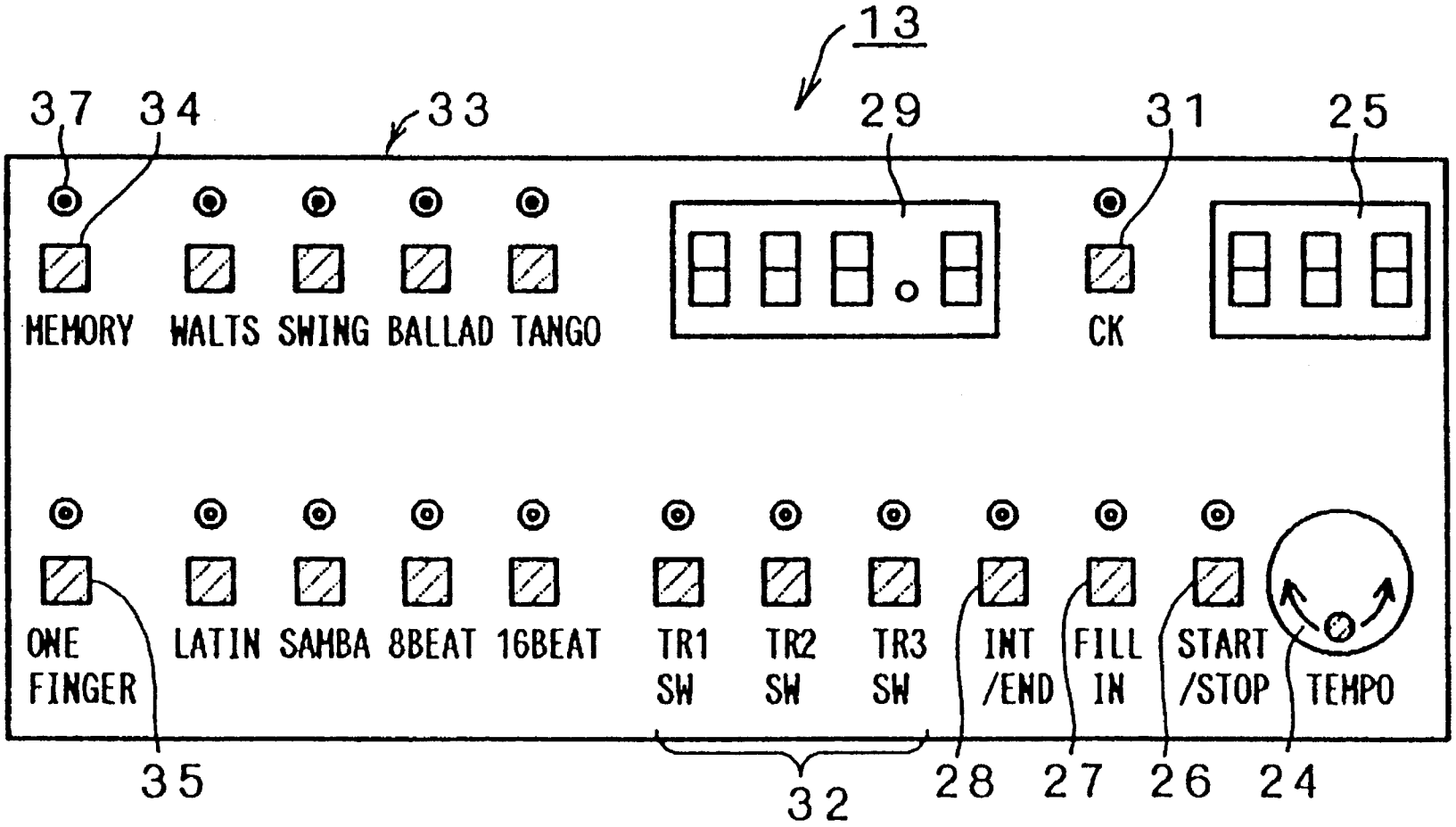
FIG. 3 is a front view of an operation panel of the electronic organ.

As shown in FIG. 3, a tempo control 24 is provided for manually establishing tempo internally, a tempo indicator 25 is provided for indicating the established tempo, and switches SW and LED 37 disposed for each of the switches are provided on the operation panel 13. The data manually instructed on the operation panel 13 are sent to CPU 1.

The switches on the operation panel 13 are now explained. As shown in FIG. 3, on the operation panel 13, START/STOP 26 is a switch for starting and stopping the accompaniment, FILL IN 27 is for inserting a specified accompaniment part during the accompaniment, and INT/END 28 is for performing a specified accompaniment at the starting and ending of the accompaniment. An accumulated bar indicator 29 is provided for indicating the number of bars performed during the accompaniment. A clock change-over switch for switching between the internal setting and external setting of tempo is designated as CK 31. TR1 SW, TR2 SW and TR3 SW are gate switches 32 for designating tracks TR1, TR2 and TR3, respectively. Three bar loops are stored in these tracks. Switches 33 consist of WALTZ, SWING, BALLAD, TANGO, LATIN, SAMBA, 8BEAT and 16BEAT switches fop selecting a desired rhythm style. With MEMORY switch 34, the accompaniment data is stored even after keys are released. Simply by touching ONE FINGER switch 35 with one finger, a desired chord can be designated.

Returning to FIG. 2, the keyboard 15 is formed by upper keys 15*a* and lower keys 15*b*, and is also provided with a not-shown switch consisting of an array for detecting the depression of each of the keys 15*a*,15*b*. The signals manually fed by the keyboard 15 and indicating accompaniment and operation are sent to CPU 1 or other.

MIDI input 17 receives MIDI input signal from the external unit and converts the signal to a parallel-transmission signal. The signal INT 1 is sent to CPU 1 for the execution of MIDI input interruption as described later and shown in FIG. 16.

The timers 19 consist of two presettable counters: TIMER 1 and TIMER 2. When the value is preset corresponding to the operation of tempo control 24 on operation panel 13, TIMER 2 counts down to zero and signal INT2 is sent to CPU 1 such that TIMER 2 tempo interruption is executed (as described later and shown in FIG. 17). TIMER 1 resets when a timing clock signal CK is supplied from MIDI input 17 to TIMER 1. The frequencies of the input of timing clock signal CK are measured by TIMER 1.

Figure 4:
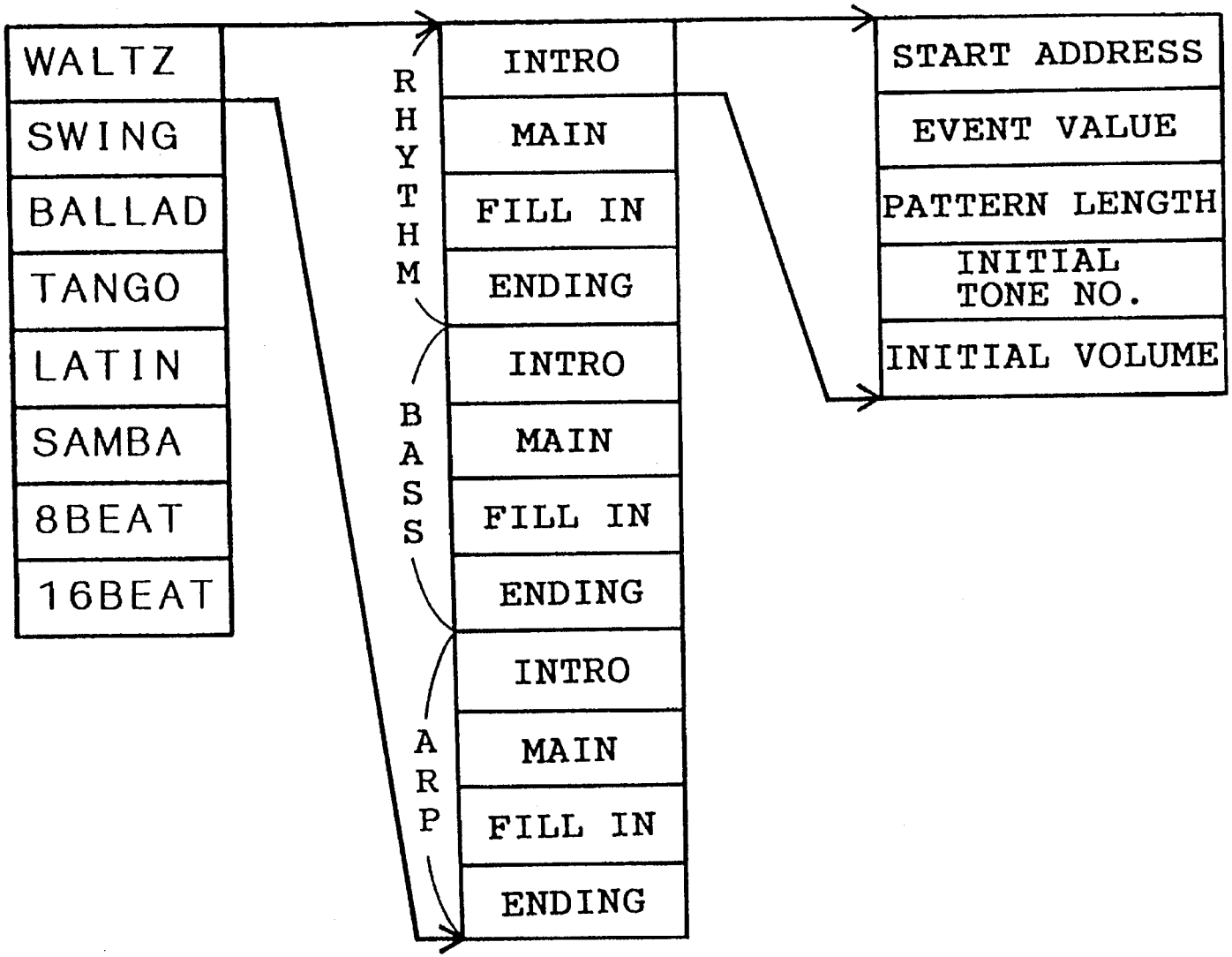
FIG. 4 is an explanatory view showing the arrangement of headers of the electronic organ.

The headers for respective automatic accompaniment data stored in ROM 5 of the electronic organ are now explained referring to FIG. 4.

Eight styles of rhythm are available: WALTZ; SWING; BALLAD; TANGO; LATIN; SAMBA; 8BEAT and 16BEAT. Each of the rhythm styles is formed by rhythm track TR1, bass track TR2 and arpeggio track TR3. Each track is composed of introduction, main, fill-in, and ending patterns.

The introduction pattern indicates that any of the introductory bars i-1,2,4 is reproduced only once. While the automatic accompaniment is stopped, the INT/END switch 28 is operated and the corresponding LED 37 is lit. By operating the START/STOP switch 26 to put the electronic organ in the condition for automatic accompaniment, any of the introductory bars i=1,2,4 is reproduced only once. The rhythm, bass and arpeggio tracks TR1, TR2, TR3 have the same length of introduction pattern. The pattern length is equivalent to the loop bar number.

Figure 5A:
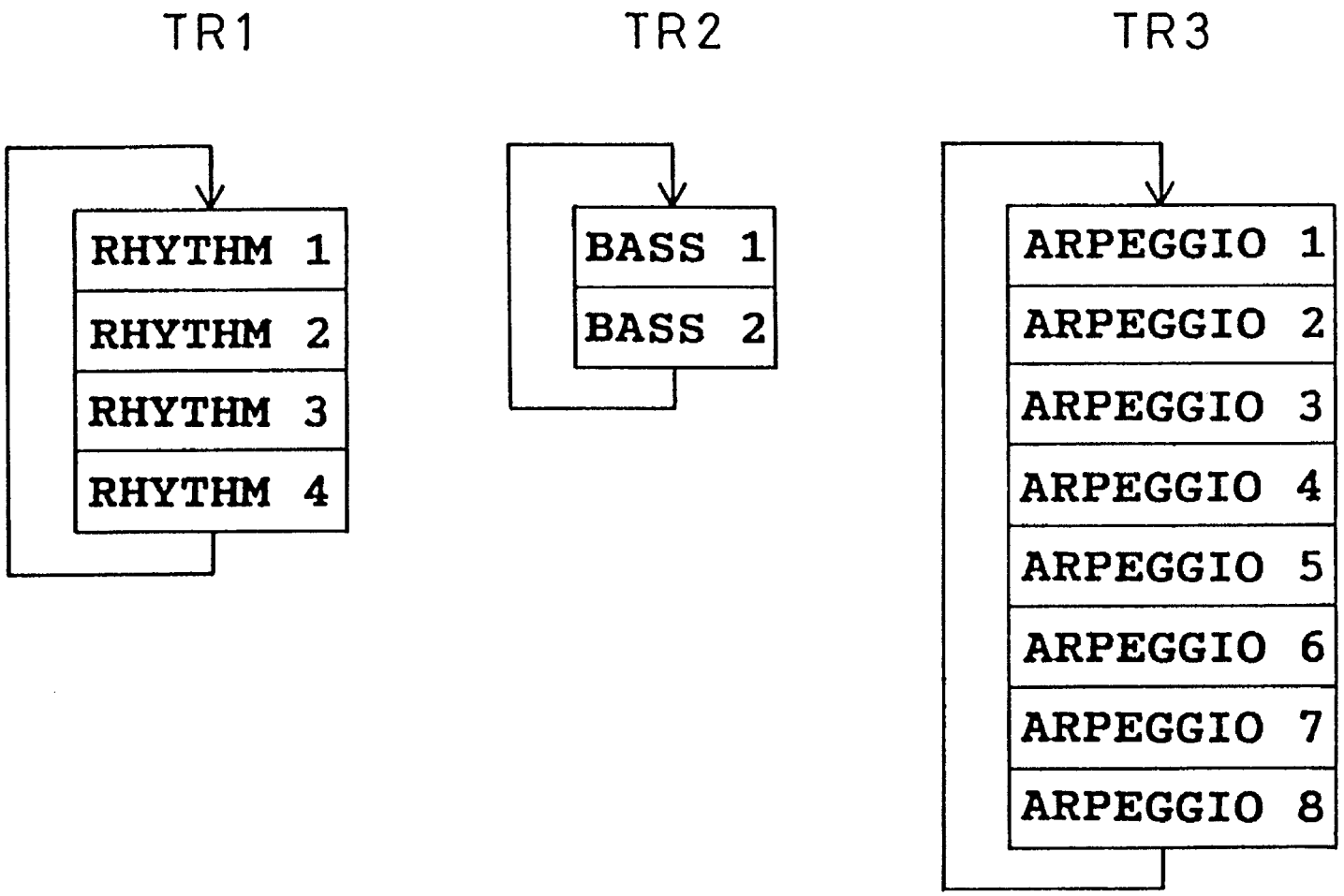

The main pattern is a normal pattern repeatedly reproduced during the automatic accompaniment. For high quality of accompaniment, the loop bar number of the main pattern is varied according to the rhythm style. The main patterns in the rhythm, bass and arpeggio tracks TR1 through TR3 have a loop bar number different from one another. As shown in FIG. 5A, for example, when rhythm style WALTZ is selected, four bars R1, R2, R3, R4 form a loop in the rhythm track TR1, two bars B1, B2 form a loop in the bass track TR2 and eight bars A1 through A8 form a loop in the arpeggio track TR3. Thus, the number of bars in a loop is set as the number 2 to the n-th power.

The fill-in pattern is the phrase inserted during or after the main pattern. While the main pattern is being reproduced, the FILL IN switch 27 on the operation panel 13 is depressed and any of bars f=1,2,4 is reproduced only once. The loop bar number of the fill-in patterns in the rhythm, bass and arpeggio tracks TR1, TR2, TR3 are the same. After the fill-in pattern is reproduced, the pointer of the main pattern jumps to the position of the bar which would have been reproduced unless interrupted by the fill-in pattern.

The ending pattern indicates that any of bars e=1,2,4 is reproduced only once. During the automatic accompaniment the INT/END switch 28 is operated and the corresponding LED 37 is lit. The START/STOP switch 26 is operated, thereby stopping the accompaniment of the electronic organ. Lastly, any of bars e=1,2,4 is reproduced only once. The loop bar number of the ending patterns in the rhythm, bass and arpeggio tracks TR1, TR2, TR3 are the same.

As shown in FIG. 4, each pattern has a start address as the top address of the corresponding pattern data, an event value indicating the total number of events in the pattern including the bar mark, a pattern length indicating the bar number of the pattern, a tone number indicating the initial tone of the pattern and a volume indicating the initial sound volume of the pattern. The tone number and volume are common data to parts A and B as described later.

Figure 6:
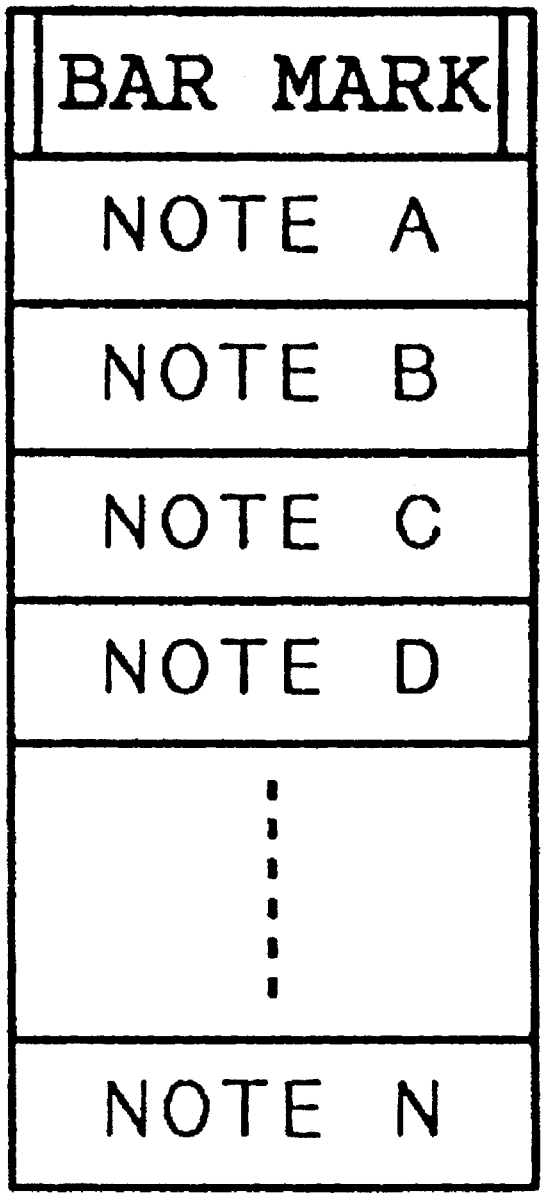
FIG. 6 is an explanatory view showing the arrangement of the data in each bar.

As shown in FIG. 6, in one bar, first a bar mark and notes A to N are arranged successively. Likewise, these note data are arranged in the bars of the rhythm, bass and arpeggio patterns. For example, when the rhythm pattern is read out instead of the bass pattern and the bass reproduction is carried out, the automatic bass can be realized, because the rhythm pattern also has the note data and the tone can be set. Therefore, the rhythm, bass and arpeggio data can be controlled in the same manner.

The structures of the accompaniment data and the bar mark are now explained referring to FIGS. 7A–7F. As shown in FIGS. 7A–7F each data consists of four bytes.

In the preferred embodiment, the accompaniment data, that is, rhythm, bass and arpeggio data are stored in tracks TR1, TR2 and TR3, respectively. Each of the rhythm, bass and arpeggio data can be sequentially stored in each track, and can be accessed with one pointer.

As shown in FIG. 7A, note data includes STEP TIME indicating the number of beats from the previous bar as the sound generating start timing, NOTE indicating the timbre, GATE TIME indicating the number of beats corresponding to the time period during which keys are depressed as the note length, VELOCITY indicating the key depression strength or touch, PA indicates the gate of part A, and PB indicates the gate of part B. These parts represent chord type groups: part A corresponds to the major mode chord group; and part B to the minor mode one. Specifically, when the selected chord group is major one, gate PA equals zero and gate PB equals one. When the selected chord group is minor one, gate PA equals one and gate PB equals zero. If the data is common to parts A and B, gates PA and PB both equal one.

In operation, in response to the depression of the lower keys 15*b* of the electronic organ, the chord type is detected. After it is determined whether the detected chord type belongs to part A or B, only the note data of the determined part A or B is reproduced. Since part gates PA and PB are stored, the pattern having the note length varied according to the chord type group can be stored more efficiently as compared to the prior art.

The LED indication data shown in FIG. 7B is used for storing and reproducing the LED's light emitting pattern inherent to the rhythm style and synchronous with the tempo. This data is included only in the rhythm track TR1. In the LED indication data, different from the note data, GATE TIME indicates the duration in which the LED is lit, and L0 through L7 correspond to eight LEDs, respectively.

For the tone data, the initial tone immediately after the start of the pattern reproduction is stored in the headers. Only when the tone is changed during the pattern reproduction, is the format of the tone data shown in FIG. 7C used. In the tone data, TONE NO. is common to parts A and B.

In the same manner as the tone data, the format of the volume data shown in FIG. 7D is used only when the sound volume is changed during the pattern reproduction.

Figure 8A:
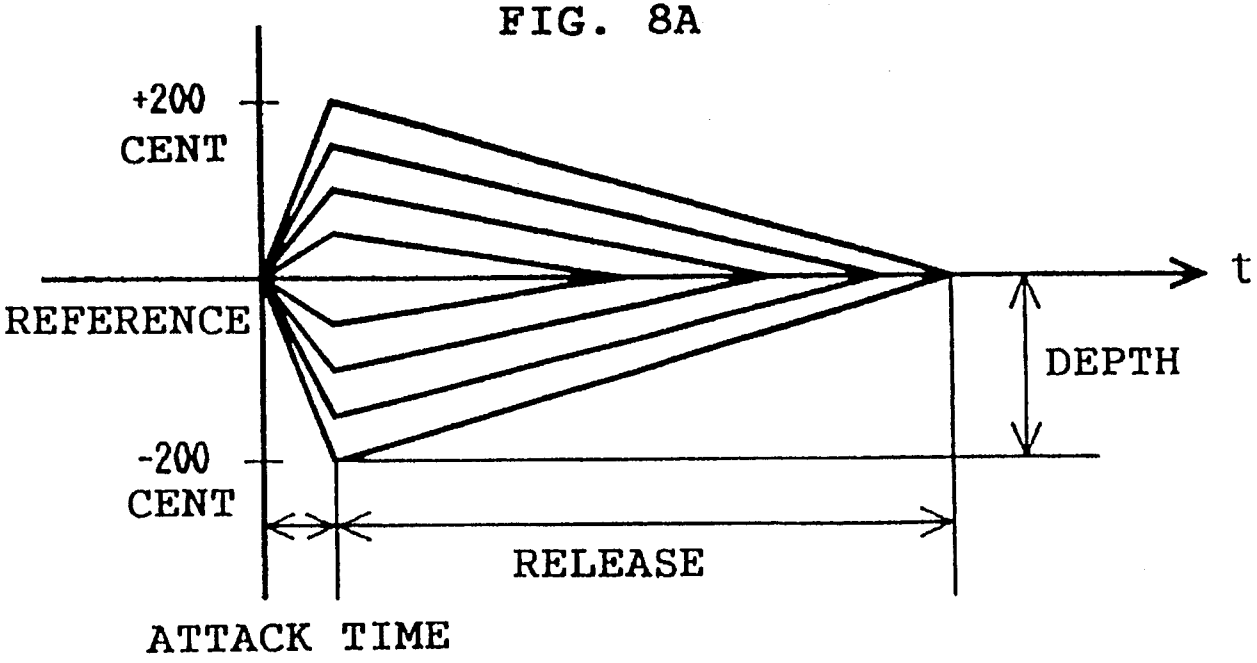
FIG. 8A is a graph showing the variation in auto-bender data and FIG. 8B is an explanatory view showing the structure of the auto-bender data.

Using the auto-bend data shown in FIG. 8A and the following Table 3, after the note being generated is deviated to the specified pitch, the deviation is eliminated gradually for a set time period to regain the reference pitch. The auto-bend data for part A can be set independently from the data for part B. In FIG. 8A the degree of the deviation from the reference pitch is represented in terms of cent.

Figure 8B:
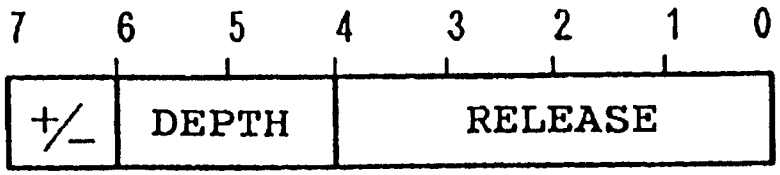

In the auto-bend data shown in FIGS. 8A and 8B, ± indicates bend up/down, DEPTH indicates the depth of bend and RELEASE TIME indicates the duration till the reference pitch is regained. As shown in FIG. 8B by optionally setting the up/down, depth and release of bend, a desired auto-bend can be formed. The attack time or the duration between the start and maximum bend is fixed as 0.1 second in the preferred embodiment, and can be varied if necessary.

TABLE 3

| DEPTH | CENT | RECOVERY TYPE | BEAT |
|---|---|---|---|
| 0 | 20 | 0 | 4 |
| 1 | 40 | 1 | 8 |
| 2 | 60 | 2 | 16 |
| 3 | 80 | 3 | 32 |
| 4 | 100 | 4 | 48 |
| 5 | 140 | 5 | 64 |
| 6 | 170 | ... | ... |
| 7 | 200 | ... | ... |
| | | ... | ... |
| | | 15 | 192 |

By using the auto-bend data, the storing of multiple analog event data as the pitch bend data is obviated.

As shown in FIG. 7E, in the second byte of the auto-bend data, when V at 0 bit equals 1, the velocity of the note touch data and the depth of the bend are multiplied as follows, such that the depth of the auto-bend can be varied according to the key depression strength. DEPTH=DEPTH× VELOCITY/64, in which VELOCITY equals 1 to 127. In the same manner, the depth and recovery time of auto-bend can be varied according to key scales.

As shown in FIG. 7F, when the step time equals 111111B, the bar mark is identified. The start bar mark has the indication of 11111101B, the mid bar of 11111110B and the end bar mark of 11111111B. Only with the indication of bar mark, can it be determined by CPU 1 whether the accompaniment is started, being performed or ended. Therefore, the CPU 1** can easily control the reading-out of the subsequent pattern, such as the main pattern subsequent to the introduction pattern, the main loop pattern, the main pattern subsequent to the fill-in pattern and the stop pattern subsequent to the ending pattern.

As shown in FIG. 7F, EVENT VALUE of the second byte of the bar mark indicate the total amount of various data within the corresponding bar. By multiplying the value by 4, the subsequent bar mark can be quickly read out. TONE NO. in the third byte and VOLUME in the four byte represent the tone and sound volume, respectively, at the start of the corresponding bar.

The event value, tone number and volume can be effectively used when the corresponding bar in the main pattern is recovered after the insertion of the fill-in pattern, the rhythm style is changed suddenly during the reproduction of the main pattern, or when the reproduction is required from the midway of the new rhythm style. Thus, the processing of data can be accelerated.

FIG. 5B illustrates the arrangement of data when the waltz pattern is selected. As vertically shown in FIG. 5B, in the rhythm data one bar forms a loop, in the bass data two bars form a loop and in the arpeggio data four bars form a loop. Different from FIGS. 7A and 7F, in FIG. 5B bytes are shown horizontally. From the left as viewed in FIG. 5B, 0 indicates the step time or the bar mark, 1 indicates the note number, 2 indicates the gate time or the common tone number, and 3 indicates gates PA, PB, the velocity or the common volume.

Figure 9:
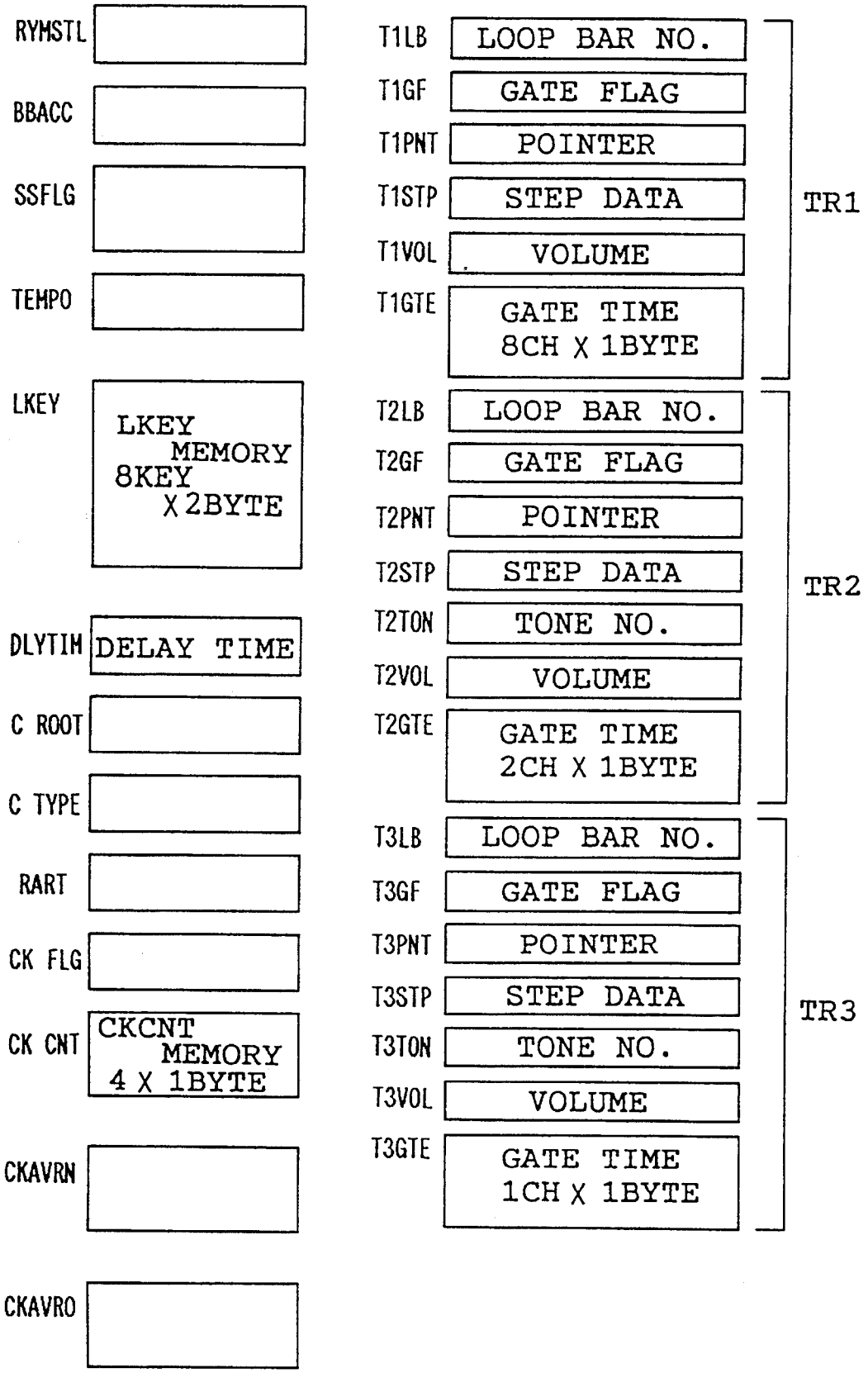
FIG. 9 is an explanatory view of each register in RAM.

Respective registers or memories in RAM 7 for CPU 1 are now explained referring to FIG. 9. The instructions and operation data entered from the operation panel 13 are stored in the registers.

Selected rhythm style memory RYMSTL stores the rhythm style selected by changing over the switches 33 on the operation panel 13, and the presently selected one among the available eight rhythm styles.

Figure 10A:
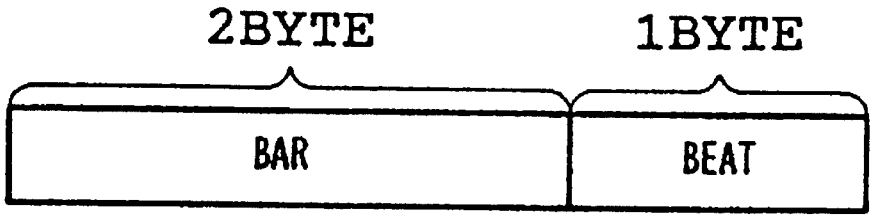
FIGS. 10A, 10B and 10C are explanatory views showing the structures of data stored in the registers.

Accumulated bar number memory BBACC is formed of two bytes of the bar number data and one byte of the beat number data as shown in FIG. 10A. The number of bars accumulated after the automatic accompaniment is started is stored in binary number. The number of beats accumulated in each bar is also stored in binary number.

Figure 10B:
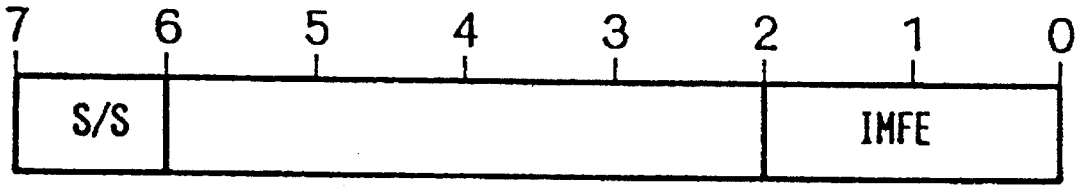

Start/stop flag memory SSFLG stores the flag indicating the condition of automatic accompaniment. As shown in FIG. 10B at bit 0,1, flag 00 indicates the introduction pattern; 01 the main pattern; 10 the fill-in pattern; and 11 the ending pattern. At bit of 7, flag SS=1 indicates the accompaniment being performed; and SS=0 the stopped accompaniment.

The tempo memory TEMPO stores the present tempo speed. For example, when a quarter note has a tempo speed of 120, the number 120 is stored in binary mode.

Figure 10C:
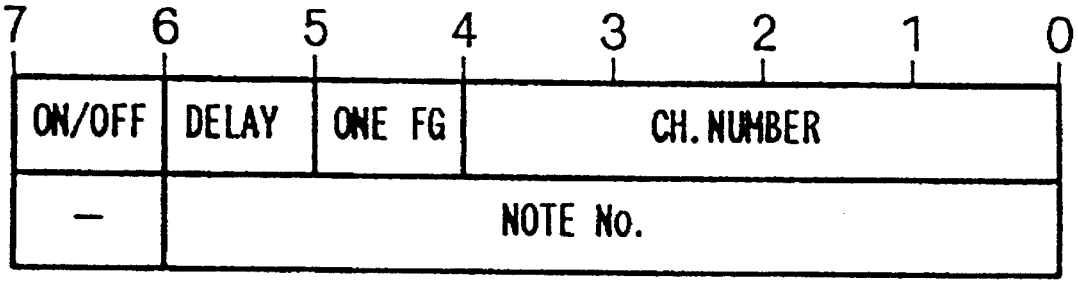

Lower key memory LKEY stores the information of the lower keys 15*b* of the electronic organ. The memory has a capacity of eight keys multiplied by two bytes. Each key has a two byte data shown in FIG. 10C. In the memory CH NUMBER 0001b indicates the manual operation of the lower keys; and 1001b the operation of the lower keys in response to MIDI signals. The key information stored in the memory LKEY is limited to the lower keys 15*b*. Flag ONE FG equals 1 when the note is added by designating the chord type or route with one finger. Flag DELAY equals 1, when only a little time has passed since the lower key event occurs, thereby indicating that the key information cannot be yet used for the detection of chord type. Flag ON/OFF indicates the depressing or releasing of the lower keys 15*b*. The MEMORY switch 34 on the operation panel 13 is operated to enter the memory mode. In the memory mode the key information is remained in the memory LKEY even after the lower keys are released. This condition is represented by the flag ON/OFF being zero.

As aforementioned, the information stored in the memory LKEY is used for detecting the chord type. The information can be used as the timbre information for generating the accompaniment pattern stored in the accompaniment pattern track. Specifically, sounds of the presently depressed lower keys 15*b* stored in the memory LKEY are sounded coincidentally at the stored timing and velocity. Sounds of up to eight keys can be sounded coincidentally.

Referring back to FIG. 9, delay time memory DLYTIM stores the interval of time during which the detection of chord type is prohibited. The value of the delay time indicates the interval of the chord type detection prohibition. The interval is specified in terms of beats as shown in the following Table 4. The resolution is a quarter note/96 beats. Therefore, when the tempo speed is a quarter note/120, the interval of the detection prohibition is 60seconds/120/96beats=5.2ms/beat. As is clearly shown, the delay time is proportional with the tempo speed in the preferred embodiment. If the tempo speed is excessively slow or fast, however, the detection prohibition interval needs to be set within a specified range by comparing it with the absolute time.

As aforementioned, when the lower key event occurs, the flag DELAY of 1 is written into the memory LKEY. According to the change in timer, one is subtracted from the value of the delay time by the main routine of CPU 1. When this subtraction makes the value zero, the flag DELAY of the corresponding memory LKEY becomes zero. Specifically, when the flag DELAY equals zero, the detection of chord type is started.

TABLE 4

| CONDITION | | | |
|---|---|---|---|
| KEY ON/OFF | MEMORY MODE | ONEFG MODE | DELAY TIME (BEATS) |
| ON | 0 | 0 | 02 |
| ON | 0 | 1 | 03 |
| ON | 1 | 0 | 03 |
| ON | 1 | 1 | 04 |
| OFF | 0 | 0 | 08 |
| OFF | 0 | 1 | 0A |
| OFF | 1 | 0 | 0C |
| OFF | 1 | 1 | 0E |

Chord root memory C ROOT stores the chord roots and the roots are processed as C(00h), C♯(01h) . . . B(OBh).

Chord type memory C TYPE stores 16 types of chords such as major minor 7th . . . in the unit of four bits.

The chord types are classified into major mode part A and minor mode part B. In the one finger mode, notes to be added or accompanied are changed according to the detected chord type.

Part designation memory PART designates part A or B. Specifically, memory PART stores that the detected chord type belongs to part A or part B. The data is stored in binary form: 0 indicates part A and 1 indicates part B.

Tempo clock flag memory CK FLG indicates that the tempo is set internally or externally. The stored flag indicates that the tempo internally set with the tempo control 24 is used or that the tempo externally calculated from the timing clock frequencies supplied from the MIDI input 17 is used. Either flag is selected by operating the CK switch 31 on the operation panel 13.

The clock count memory CK CNT stores the intervals among the four timing clock signals recently supplied from the MIDI input 17.

The clock new average memory CKAVRN stores the average of the recent four intervals stored in the memory CK CNT.

The clock old average memory CKAVRO stores the average of the intervals among the presently used four timing clock signals.

When the aforementioned flag CK FLG indicates the external setting, the value stored in the memory CKAVRO is used for calculating the preset value of TIMER 2. If the difference between the values of the memory CKAVRN and CKAVRO reaches or exceeds a specified value, the value of the memory CKAVRO is updated to the one of CKAVRN.

The rhythm track TR1 has the registers shown in the following Table 5.

TABLE 5

| | |
|---|---|
| Loop bar number T1LB | The value of pattern length stored in the header. The number of bars in one loop is indicated. |
| Gate Flag T1GF | The flag is controlled by operating TR1 SW of the gate switches 32 on the operation panel 13. When the flag equals one, reproduction is executed. |
| Pointer T1PNT | An address for reading out the accompaniment data stored in ROM 5. The pointer moves according to the number of accumulated bars. |
| Step data T1STP | This register stores the timing step data to be read out next. This data is compared with the beat data of the accumulated bars. |
| Play bar T1PB | This register stores which bar of the accompaniment data is being reproduced. For example, when four bars forms a loop, either of 0,1,2,3 is stored. |
| Gate time T1GTE | The time interval in which keys forming the rhythm notes are depressed is indicated. Six keys at maximum can be sounded coincidentally. Therefore, the register has a capacity of eight bytes. The number of beats corresponding to rhythm sound generating time interval is stored. |

The bass track TR2 and the arpeggio track TR3 have registers similar to those of TR1. These are different from the rhythm pattern, although two keys can be sounded coincidentally in the bass pattern and six keys can be sounded coincidentally in the arpeggio pattern, the gate time registers T2GTE and T3GTE have a capacity of one byte.

The operation of the electronic organ having the aforementioned structure is now explained, referring to the flowcharts of FIGS. 11–17.

Figure 11A:
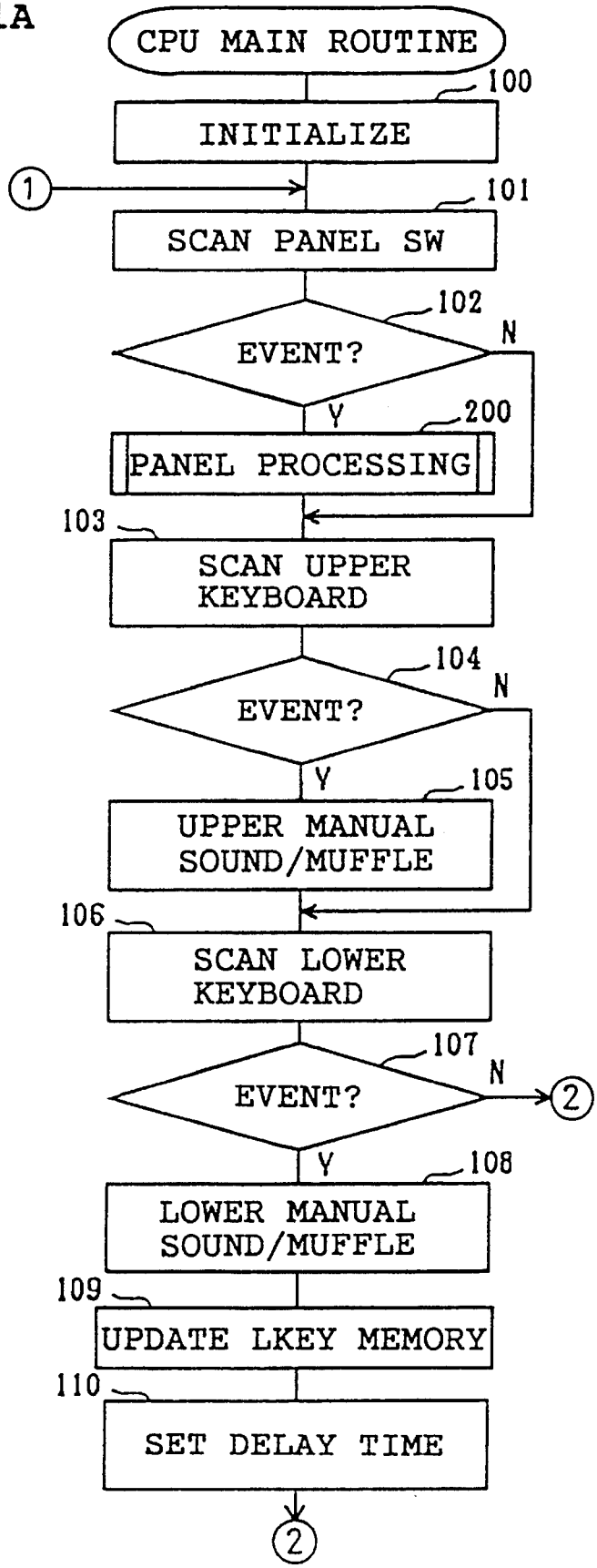
FIGS. 11A, 11B an 1C are flowcharts showing the CPU main routine.
Figure 11B:
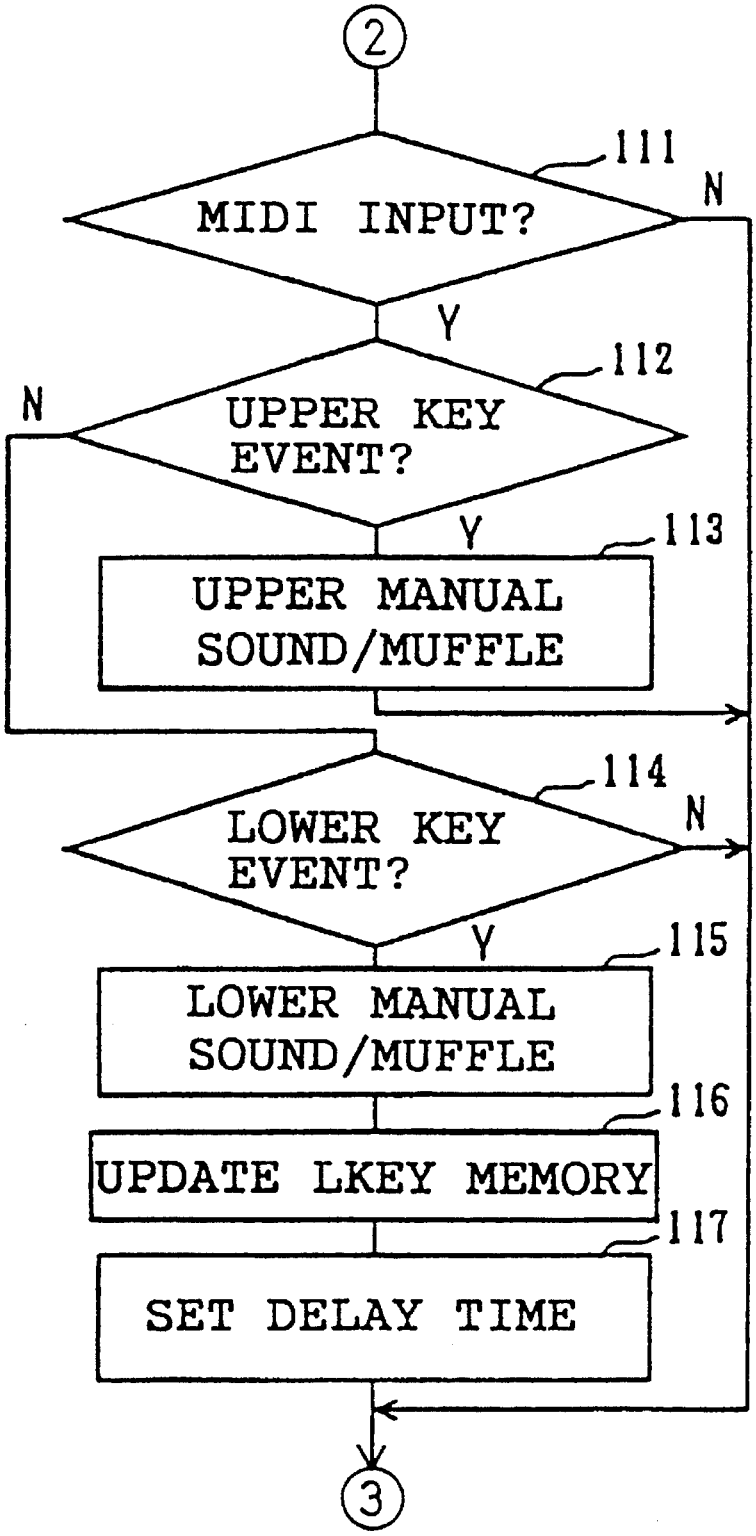
Figure 11C:
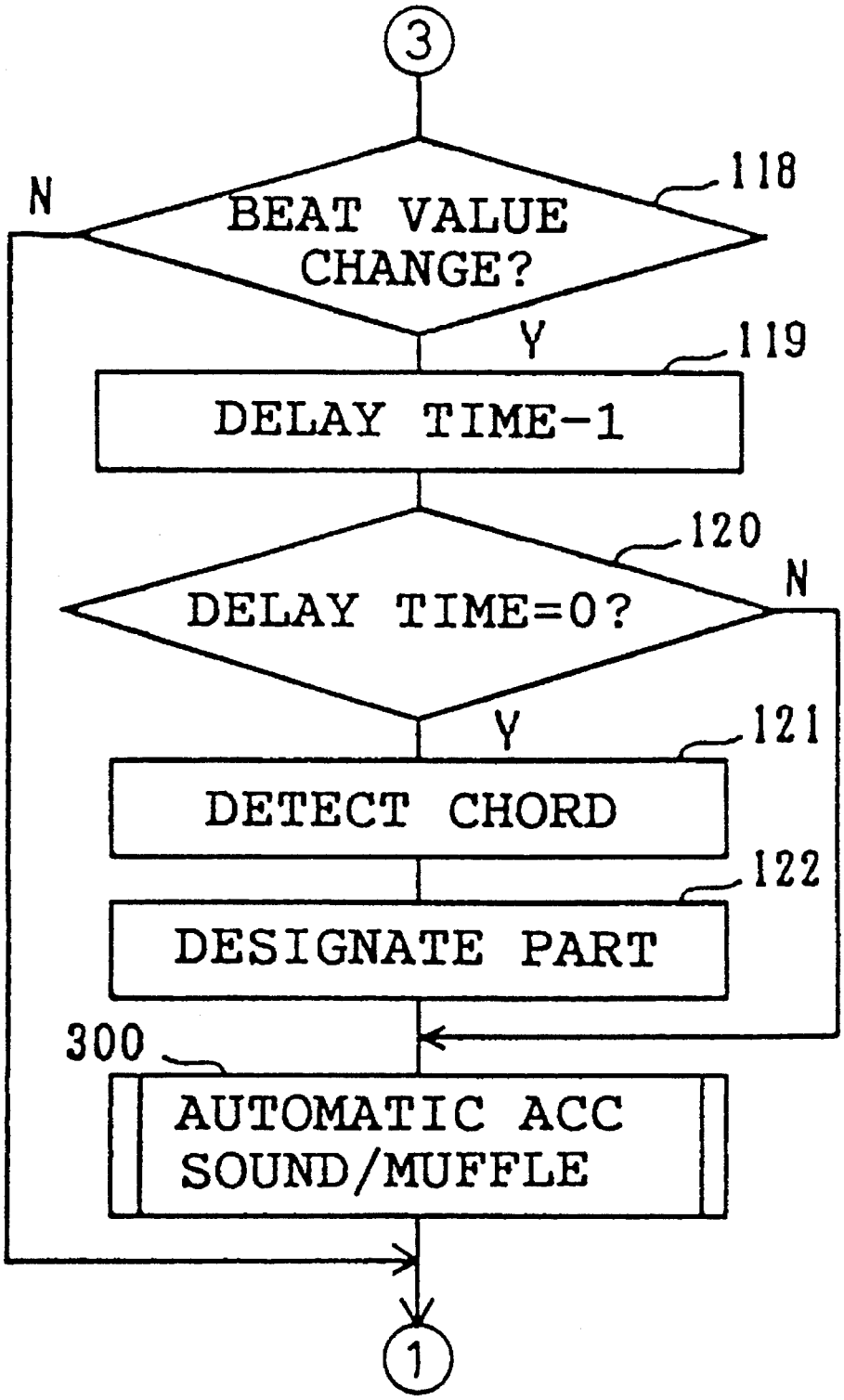

First the main routine of the entire control in CPU 1 is explained referring to the flowchart of FIGS. 11A–11C.

First, at step 100 initialization is carried out after the power switch is turned on, such that indications on the panel, respective registers, sound source parameters and other associated elements are reset to the initial condition.

At step 101 the switches provided on the operation panel are scanned and at step 102 it is determined whether or not an event occurs on each of the switches. If there is an event occurrence, at step 200 as described later the processing on the operation panel is executed.

If at step 102 there is no event occurrence, at step 103, the keyboard switch of the upper keys 15*a* is scanned, and at step 104 an event occurrence is detected. If there is an event occurrence, at step 105, the upper keys 15*a* are sounded or muffled.

If at step 104 there is no event occurrence, at step 106 the keyboard switch of the lower keys 15*b* is scanned and at step 107 it is determined whether or not there is an event occurrence of the keyboard switch. If there is an event occurrence, at step 108 the lower keys 15*b* are sounded or muffled. Subsequently, at step 109 the memory LKEY is updated and at step 110 the delay time is set.

If at step 107 there is no event occurrence, it is determined at step 111 whether or not there is an MIDI input in the MIDI buffer. If there is an MIDI input, at step 112 it is determined whether the MIDI input is an upper key event or not. If there is no MIDI input at step 111, flow goes to 118.

If the upper key event is determined at step 112, at step 113 the upper keys 15*a* are manually sounded or muffled and flow goes to 118.

If there is no upper key event at step 112, at step 114 it is determined whether the MIDI input is a lower key event or not.

If the lower key event as the accompaniment data is entered at step 114, at step 115 the lower keys 15*b* are manually sounded or muffled according to the MIDI input. Subsequently, at step 116 the memory LKEY is updated and at step 117 the delay time is set.

If there is no lower key event at step 114, flow goes to 118.

At step 118 it is determined whether or not a change occurs in the beat data. Specifically, the present value of the beat data stored in the lower eight bits of memory BBACC shown in FIG. 10A is compared with the value of the beat data when this step 118 was passed previously. If there is no change at step 118, flow goes back to 101. If a change is identified at step 118, at step 119 one is subtracted from the value of the delay time stored in the memory DLYTIM.

After the value of the delay time is decremented by one, the value of the delay time in the memory DLYTIM is detected. When at step 120 the value of delay time equals zero after the decrement, the time interval for prohibiting the detection of the chord type is expired. Subsequently, at step 121 by searching the memory C TYPE and C ROOT, chord type or root is detected and flow goes to 122.

If at step 120 the value of delay time in the memory DLYTIM does not equal zero, flow goes to 300 as described below.

At step 122, based on the chord type detected at step 121, part A of major mode or part B of minor mode is designated and stored in memory PART.

Specifically, when the detected chord type is classified in the major chord type group, the value of memory PART is set at zero, thereby designating Part A. On the other hand, when the detected chord type is classified in the minor chord group, the value of memory PART is set at one, thereby designating Part B.

Subsequently, after at step 300 keys are sounded or muffled for automatic accompaniment as described below, and flow returns to 101.

As aforementioned, at steps 100 through 300, the operation panel 13 and the keyboard are scanned, the existence of the MIDI input is detected, and the keys are sounded or muffled based on the input. At the same time, by detecting the chord type, the chord type group to which the detected type belongs is determined.

Figure 12A:
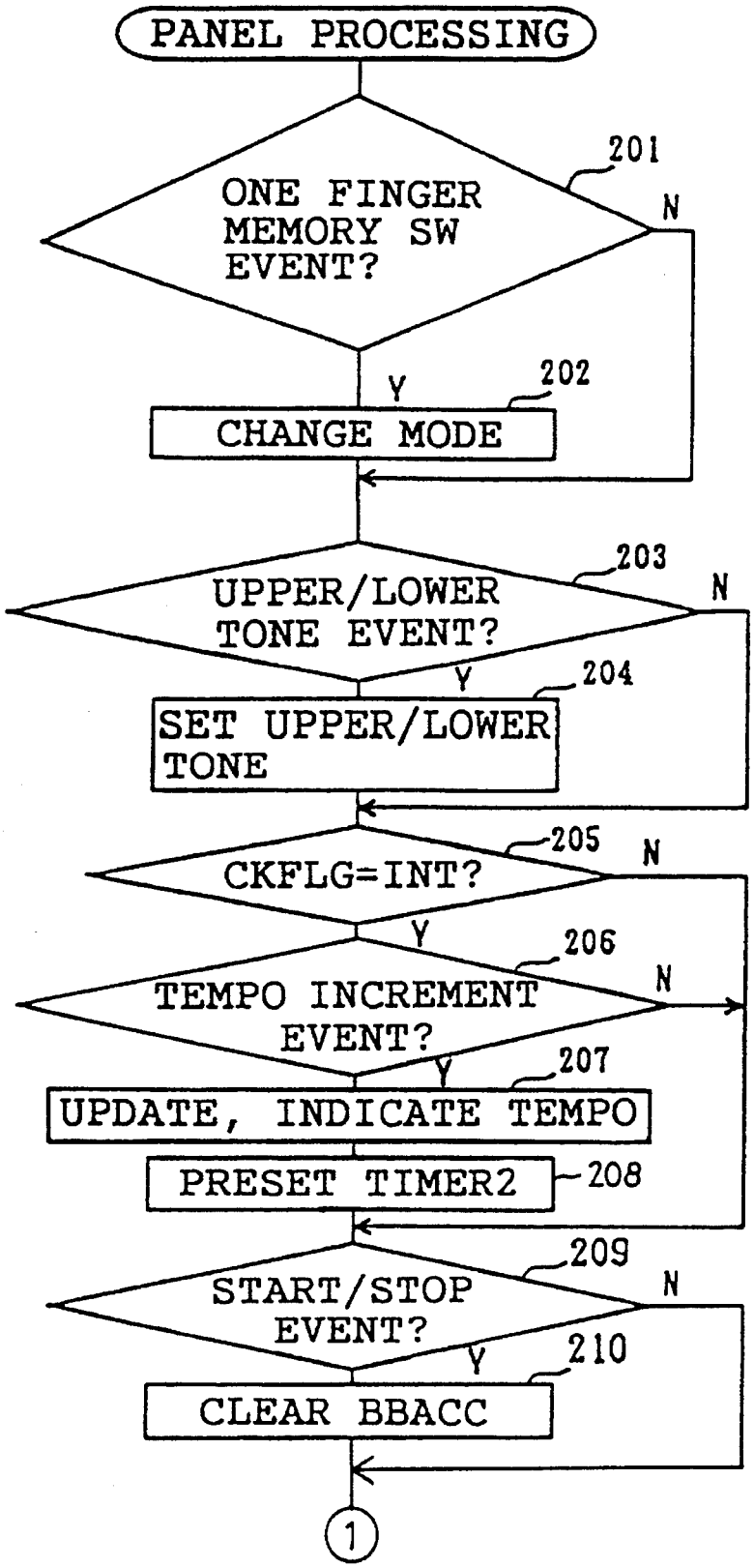
FIGS. 12A, 12B and 13 are flowcharts showing the part of panel processings.
Figure 12B:
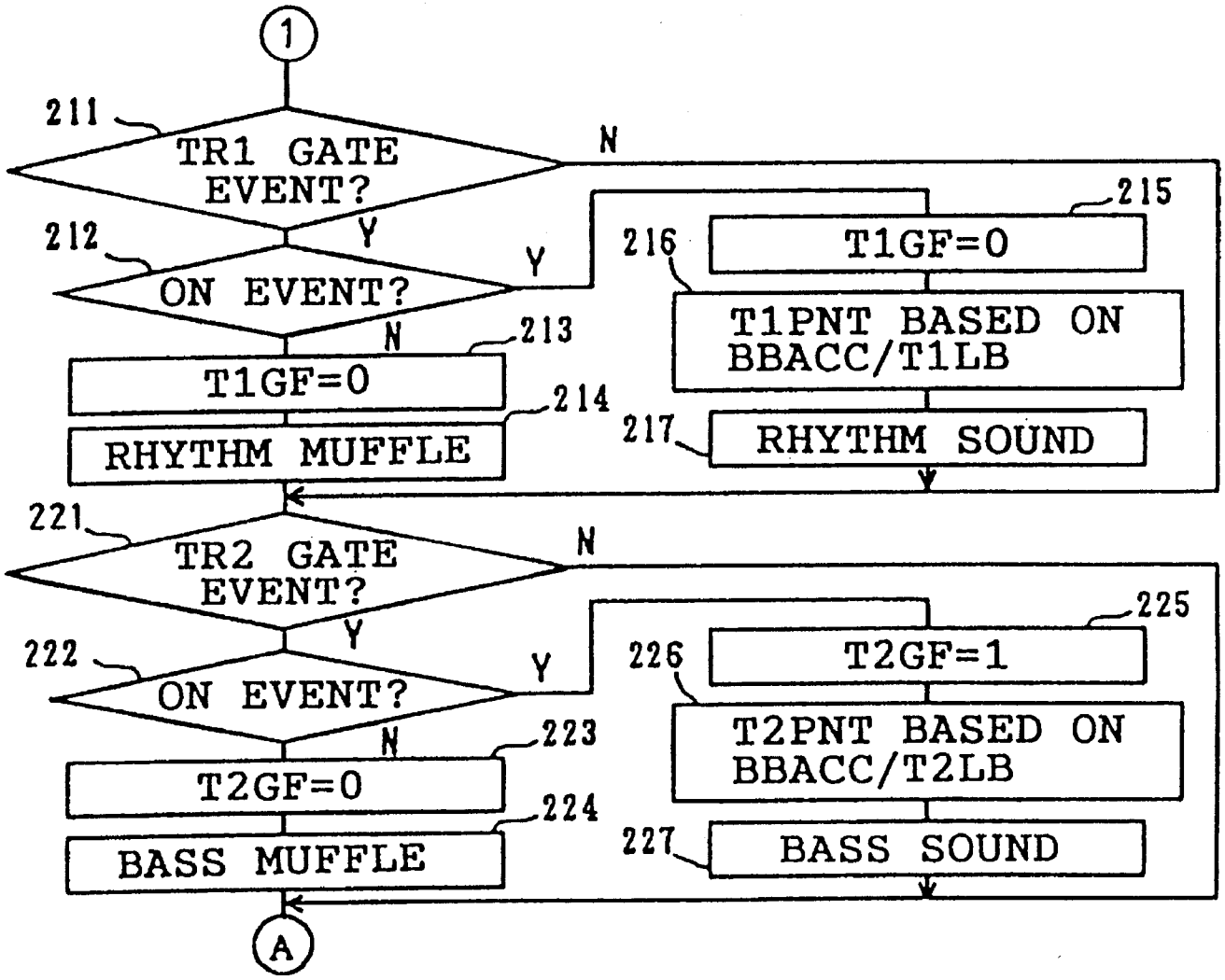

The processing on the operation panel 13 at step 200, an important aspect of the preferred embodiment, is now explained referring to the flowchart of FIGS. 12A and 12B. At step 201 it is determined whether or not there is an on event of the ONE FINGER switch 35 or the MEMORY switch 34. If either switch is turned on, in step 202 the LED 37 corresponding to the turned switch is lit and the rhythm style is changed.

If at step 201 neither switch is turned on, in step 203 it is determined whether or not there is an on event of the not-shown note switch on the operation panel 13 for the upper and lower keys 15*a*, 15*b*. Specifically, it is determined whether or not the tone is changed. If the tone change is detected at step 203, at step 204 note data is updated and sent to the sound generator 9.

If there is no tone change at step 203, it is determined at step 205 whether or not the flag of the tempo clock flag memory CK FLG equals INT and indicates that the tempo is internally set. If flag CKFLG indicates INT, flow goes to 206, and if not, flow goes to 209.

At step 206 it is determined whether or not there is a tempo increment. If a signal instructing tempo change is sent from the tempo control 24 at step 206, in step 207 the stored tempo data is updated as well as the tempo indication on the operation panel 13. The value of the delay time is also updated accordingly.

Subsequently, at step 208 the preset value of TIMER 2 is updated, thereby modifying the synchronization of the interruption of signal INT2 as described later.

At step 209 it is determined whether or not there is an event of flag S/S stored at bit 7 in the start/stop flag memory SSFLG. The event corresponds to a start or stop event. At step 210 the value stored in accumulated bar number memory BBACC is cleared.

If at step 209 there is no event of the start/stop flag, at step 211 it is determined whether or not there is a change in gate flag T1GF in rhythm track TR1. If there is a change, flow goes to 212, and if not, flow goes to 221.

At step 212 it is determined whether there is an event of ON and flag OFF is changed to flag ON. If not, it indicates that the data in rhythm track TR1 is no longer reproduced. Therefore, at step 213 gate flag T1GF is set to zero and at step 214 the sound being generated according to the rhythm pattern is deadened.

If at step 212 there is an ON event, it indicates that the data stored in rhythm track TR1 is newly or midway reproduced. Specifically, the arpeggio track is changed. Therefore, at step 215 gate flag T1GF in the rhythm track TR1 is set to one, and flow goes to step 216.

At step 216 accumulated bar number BBACC is divided by loop bar number T1LB in the rhythm track TR1. The remainder bar number resulting from dividing the present pointer T1PNT of the rhythm track TR1 is determined. The address determined corresponding to the remainder bar number is set as the present pointer T1PNT of rhythm track TR1. Specifically, at step 216 when the track is changed to another track having a different loop bar number, the bar to be next performed for accompaniment is easily determined.

At subsequent step 217 sound is generated according to the rhythm pattern. To determine the set sound volume in the beat data of the present bar first, the volume is read out from the present bar mark shown in FIG. 7F and stored into register T1VOL in the rhythm track TR1 shown in FIG. 9. If there is any further volume data, register T1VOL stores it. The volume data of register T1VOL is sent to the sound generator 9. Subsequently, if there is any further rhythm pattern to be reproduced at the timing, sound is generated according to the corresponding rhythm pattern.

Figure 13:
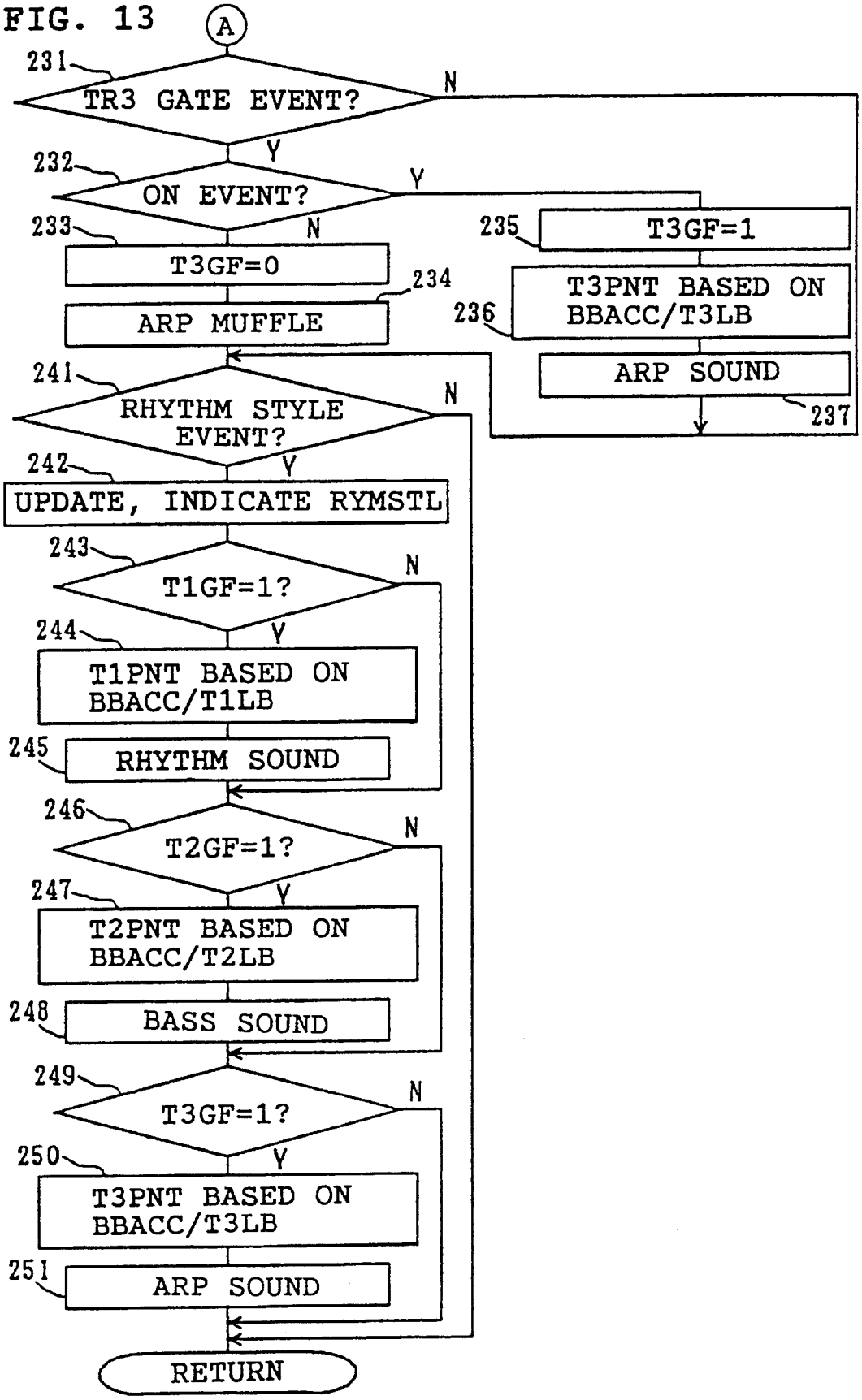

Subsequent steps 221, 222, 223, 224, 225, 226 and 227 for the processing of data stored in bass track TR2 correspond to the aforementioned steps 211, 212, 213, 214, 215, 216 and 217, respectively. In the flowchart of FIG. 13 steps 231 through 237 for the processing of data stored in arpeggio track TR3 also correspond to the aforementioned steps 211 through 217, respectively. These corresponding steps are not herein detailed because substantially the same steps are executed as those for the processing of data stored in rhythm track TR1.

Different from step 217, however, at steps 227 and 237 when generating sound according to the bass and arpeggio pattern, the tone number is set.

Specifically, at step 227 the set sound volume and note in the beat data of the present bar are determined, then the tone number and volume are read out from the present bar mark shown in FIG. 7F and stored into registers T2TON and T2VOL, respectively, of bass track TR2 as shown in FIG. 9. If there are any further tone number and volume data in registers T2TON and T2VOL, the registers store them.

Subsequently, at step 241 in the flowchart of FIG. 13 it is determined whether or not there is an event of rhythm style. If it is determined at step 241 that a new rhythm style is selected by operating either of the switches 33 of the operation panel 13, the new rhythm style number is stored in the selected rhythm style memory RYMSTL, and LED 37 corresponding to the operated switch 33 is lit.

Subsequently, it is determined at step 243 whether or not gate flag T1GF in rhythm track TR1 equals 1. If flag T1GF equals one, at step 244 the bar to be sounded next is determined. At step 244 in order to change the rhythm style and start the new rhythm style during the accompaniment, in the same manner as step 216, accumulated bar number BBACC is divided by loop bar number T1LB in rhythm track TR1. Based on the remainder bar number resulting from the division the present pointer T1PNT of rhythm track TR1 is determined. The address corresponding to the remainder bar number is set as the present pointer T1PNT.

At step 245, in the same manner as step 217, sound is generated according to the rhythm pattern.

Subsequently, it is determined at step 246 whether or not gate flag T2GF in bass track TR2 equals 1. If flag T2GF equals one, at step 247 the bar to be sounded next is determined. Subsequent steps 247 and 248 correspond to steps 244 and 245 for the processing of data in rhythm track TR1, respectively. At step 247, accumulated bar number BBACC is divided by loop bar number T2LB in bass track TR2. Based on the remainder bar number resulting from the division the present pointer T2PNT of bass track TR2 is determined. At step 248 sound is generated according to the bass pattern.

Subsequently, it is determined at step 249 whether or not gate flag T3GF in arpeggio track TR3 equals 1. If flag T3GF equals one, in step 250 the bar to be sounded next is determined. Steps 250 and 251 correspond to steps 247 and 248. At steps 248 and 251 the tone data as well as the volume data is read out for the sound generation.

As aforementioned in steps 201 through 251, by operating the switches provided on the operation panel 13 the position at which the loop bar is to be sounded is designated and sound is generated.

Figure 14A:
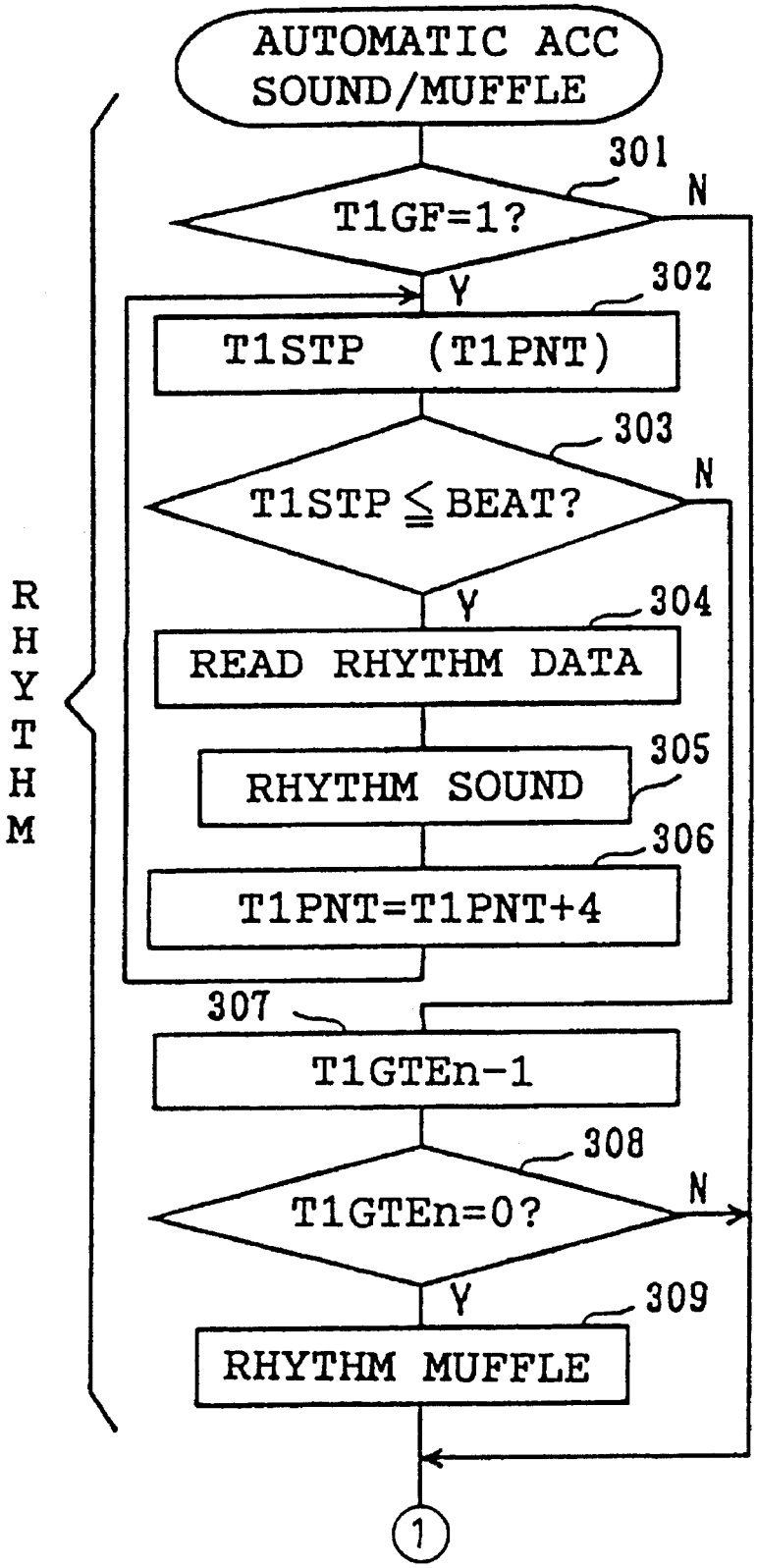
FIGS. 14A, 14B and 15 are flowcharts showing part of automatic accompaniment sound generating and muffling.
Figure 14B:
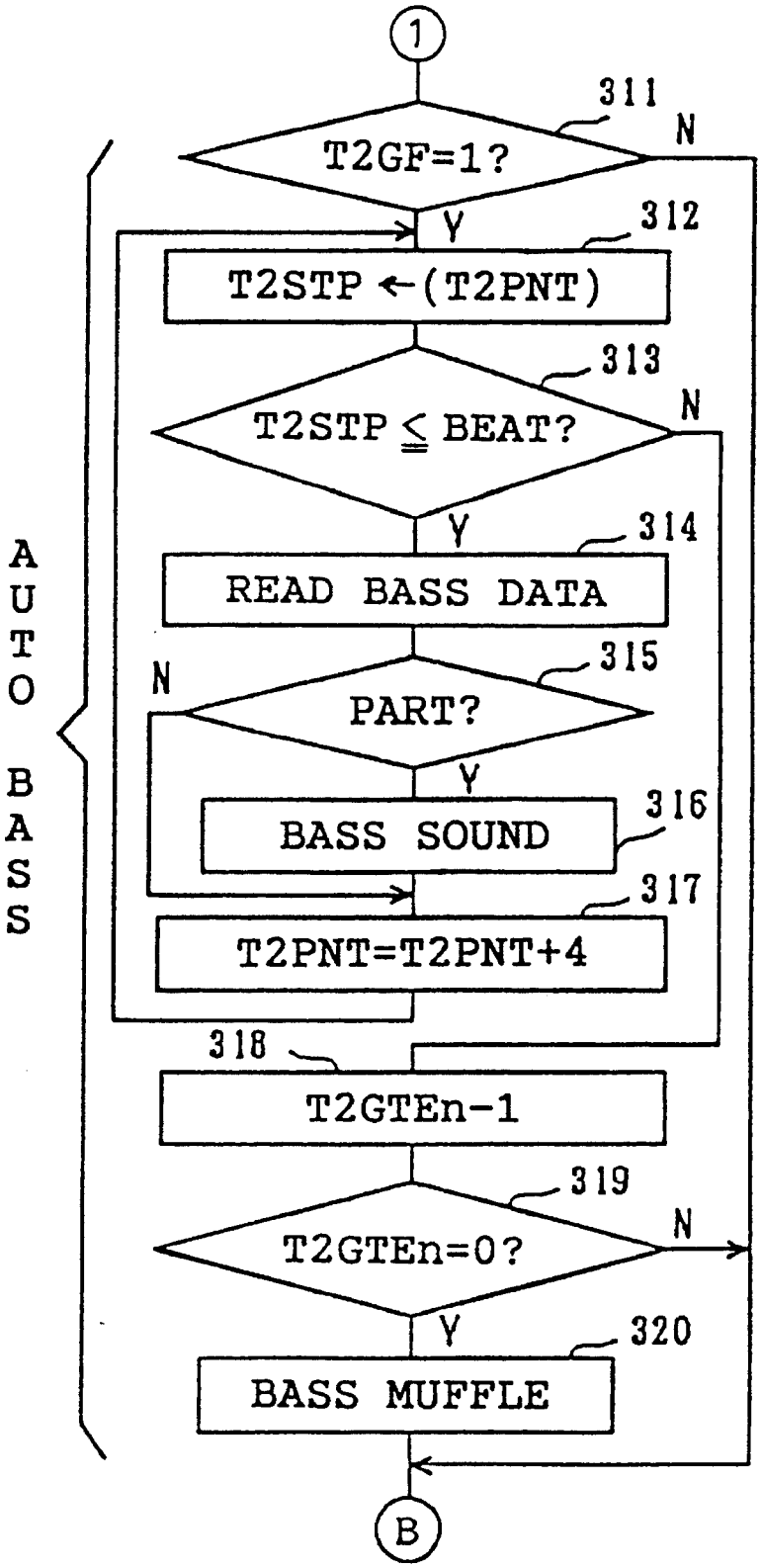

Step 300 of sound generating and muffling for automatic accompaniment in the flowchart of FIG. 11C is now explained referring to the flowchart of FIGS. 14A and 14B.

In the subroutine of the flowchart in FIGS. 14A and 14B, at the timing based on the advancement of the accumulated bar number and beat number caused by the interruption of TIMER2, the data for automatic accompaniment is read out from tracks TR1, TR2 and TR3, and sound is generated. Conventionally, this subroutine is performed as the processing of the interruption of TIMER 2 occurs. In the conventional art, a long time period is required for the interruption. Furthermore, if another interruption arises, key scanning in the main routine is neglected. Therefore, in the preferred embodiment, the subroutine of automatic accompaniment is incorporated in the main routine.

First it is determined at step 301 whether or not gate flag T1GF in rhythm track TR1 equals one. If flag T1GF equals one, at step 302 the step time is read out from the address represented by the present pointer T1PNT and stored into register T1STP in rhythm track TR1. If flag T1GF does not equal one, flow goes to 311.

At step 303 the aforementioned step time is compared with the present beat data and it is determined if the beat data exceeds the step time. If the beat data equals or exceeds the step time, at step 304 the rhythm data is read out from addresses +1, +2, +3 of pointer T1PNT. The addresses +1, +2, +3 correspond to the data stored in first, second and third byte, respectively, shown in FIGS. 7A through 7F. At step 305 of the sound generation according to the rhythm pattern, the sounding instruction is allotted to the sound generator 9 and the gate time required for the sound generation is stored in either of eight channels of register T1GTE.

If at step 303 the beat data is less than the step time, flow leaves the looped steps and goes to 307.

At step 306 pointer T1PNT is advanced by four and the address of the next rhythm data is determined. Subsequently, returning to step 302, it is determined whether the next rhythm data can be reproduced at that time. If it is determined at step 303 that all the rhythm data to be reproduced at that time is read out, at step 307 one is subtracted from gate time T1GTEn stored in either of the eight channels of rhythm track TR1. If gate time T1GTEn is already zero, the subtraction is not needed.

Subsequently, it is determined at step 308 whether or not gate time T1GTEn becomes zero after the subtraction of one. If gate time T1GTEn is zero, it is determined that the sound generation according to the rhythm pattern is completed. At step 309 the envelope corresponding to the rhythm pattern is released and sound is stopped.

If gate time T1GTEn does not equal to zero, it is determined at step 311 whether or not gate flag T2GF in bass track TR2 equals one. If gate flag T2GF equals one, at step 312 the step time read out from the address represented by the present pointer T2PNT is stored into register T2STP in bass track TR2. If gate flag T2GF is not one, flow goes to 321 shown in the flowchart of FIG. 15.

At step 313 the step time is compared with the present beat data and it is determined if the beat data exceeds the step time. If the beat data equals or exceeds the step time, flow goes to 314 and if the beat data is less than the step time, flow goes to 318.

At step 314 the bass data is read out from addresses +2, +3, +4 of pointer T2PNT.

In step 315 by comparing the data PA, PB for major and minor mode parts A, B read out at the address T2PNT+4 with the designated part in memory PART of RAM 7, it is determined if the read out bass data is as designated. If the designated part belongs to major mode part A, the data in register PART is set as zero. Data PA is zero and data PB is one. After comparing these values, the accompaniment data corresponding to data PA having a value of zero is read out.

If the data for the designated part is identified at step 315, in step 316 sound is generated according to the bass pattern. First, any bias required in the specific note in chord type memory C TYPE is added to the read out sound volume data, and the data in chord root memory C ROOT is also added. If the resulting data is out of the designated sound range, octave movement is required. The chord data is allotted to the sound generator 9, and the present gate time is stored into either of the two bytes of register T2GTE of bass track TR2.

If at step 315 the data is not designated, at step 317, pointer T2PNT is advanced by four and the next bass data is addressed. Returning back to step 312, it is determined whether or not the next bass data is to be reproduced at the same time. At step 313 all the bass data to be reproduced at this time is read out. Subsequently, at step 318 one is subtracted from gate time T2GTEn of two channels in bass track TR2. If gate time T2GTEn is already zero, the subtraction is not needed.

Subsequently, it is determined at step 319 whether or not gate time T2GTE is zero after the subtraction of one. If gate time T2GTE is zero, it is determined that the sound generation according to the bass pattern is completed. At step 320 the envelope corresponding to the bass data is released and sound is stopped. If gate time T2GTEn is not zero, flow goes to 321.

Figure 15:
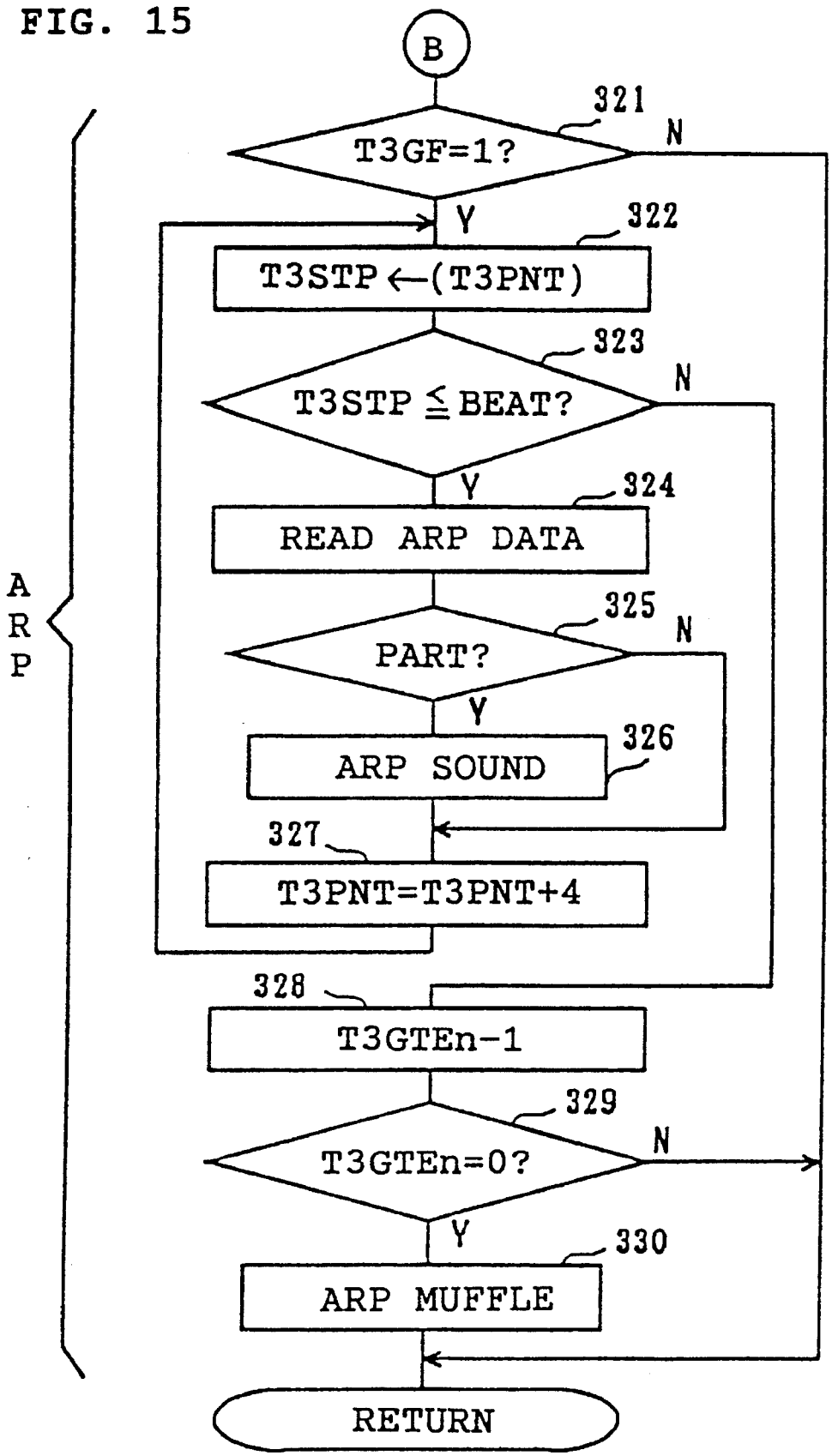

Steps 321 through 330 are for reading out the arpeggio data for sound generation shown in the flowchart of FIG. 15 and correspond to the aforementioned steps 311 through 320, respectively. Therefore, explanation is omitted.

Different from the bass accompaniment, however, is step 326 where the key information for at most eight keys is stored in lower key memory LKEY and is coincidentally allotted to the sound generator 9 at the read out timing and velocity. The gate time, which is the same in the key information, can be controlled only once.

At steps 301 through 309 sound is generated and stopped according to the rhythm pattern. At steps 311 through 320 sound is generated and stopped according to the bass pattern, and at steps 321 through 330 sound is generated and stopped according to the arpeggio pattern. At steps 311 through 320 and steps 321 through 330 it is determined whether or not the read out belongs to the designated part. In the accompaniment data the rhythm pattern is common to parts A and B. Therefore, steps 301 through 309 do not incorporate the steps corresponding to steps 315 and 325.

Figure 16:
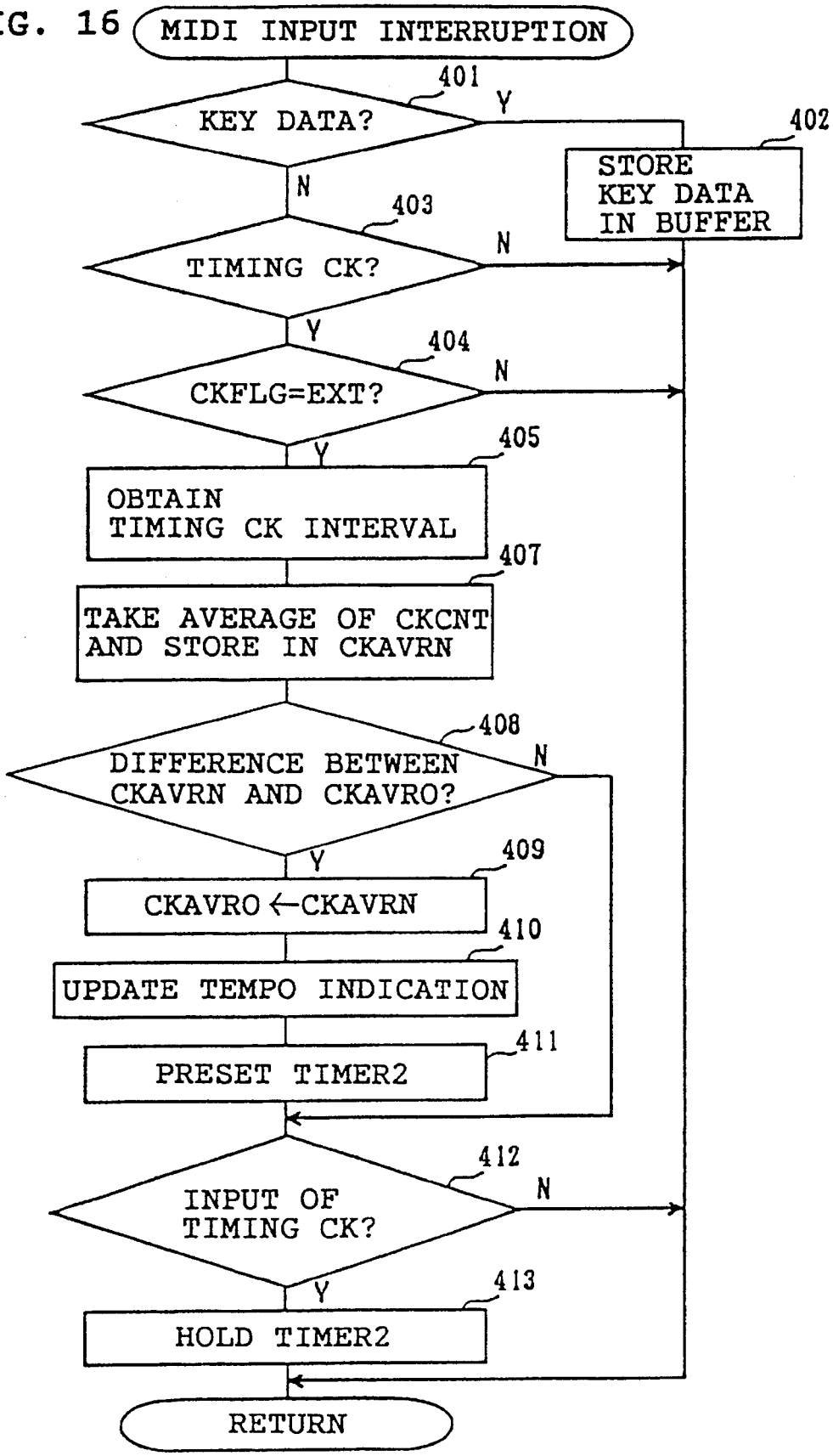
FIG. 16 is a flowchart showing the interruption by the input of MIDI.

The routine for the interruption of INT1 entered from the MIDI input 17 is now explained referring to the flowchart of FIG. 16. In the interruption routine, the tempo speed is set corresponding to the data entered from the MIDI input 17 and the key chord is stored in the MIDI buffer. When the flag of tempo clock flag memory CK FLG indicates that tempo is externally set, using the value calculated from the timing clock frequencies supplied from the MIDI input 17, TIMER2 is operated as described later and shown in the flowchart of FIG. 17.

In the MIDI input interruption routine, at step 401, it is determined whether or not the MIDI input data contains key information. If it is determined at step 401 that the key information is entered from the MIDI input 17, at step 402 the key information is stored into the MIDI buffer.

If there is no input of key information, at step 403 it is determined whether or not the MIDI input data is timing clock data. If it is determined at step 403 that the timing clock is entered from the MIDI input 17, at step 404 it is determined whether or not tempo clock flag CKFLG indicates that the tempo is externally set.

If it is determined at step 404 that the tempo is externally set, at step 405 the time interval between the previous and present timing clocks is read out from TIMER1. The obtained time interval between the previous and present timing clocks is stored into clock count memory CK CNT.

Subsequently, at step 407 an average is taken from the most recent four time intervals including the time interval stored in clock count memory CK CNT, and stored into clock new average memory CKAVRN.

At step 408 the new average stored in clock new average memory CKAVRN is compared with the old average stored in clock old average memory CKAVRO and the present tempo speed is formed. It is then determined whether or not the difference between the averages equals or exceeds the specified difference.

If at step 408 the difference equals or exceeds the specified value, to update the tempo speed, at step 409 the value of memory CKAVRN is sent to memory CKAVRO and replaces the value in memory CKAVRO. At step 410 based on the replaced value in clock old average memory CKAVRO, the tempo indication is updated. At step 411 the preset value is updated based on the changed value in clock old average memory CKAVRO, and is sent to TIMER2, and flow goes to 412.

If at step 408 the difference is less than the specified value, flow also goes to 412.

At step 412 it is determined whether or not there is an input of the timing clock for a specified time period. If there is no input at step 412, at step 413 TIMER2 is held and the routine ends.

At steps 401 through 413 if there is an input of timing clock from the MIDI input 17, it is determined that the tempo is externally set. The time interval between the previous and present timing clocks is obtained and an average is taken from the recent four time intervals. By using the new average under the specified conditions, the tempo is updated. Therefore, even if the tempo is varied, a new tempo can be appropriately set.

Figure 17:
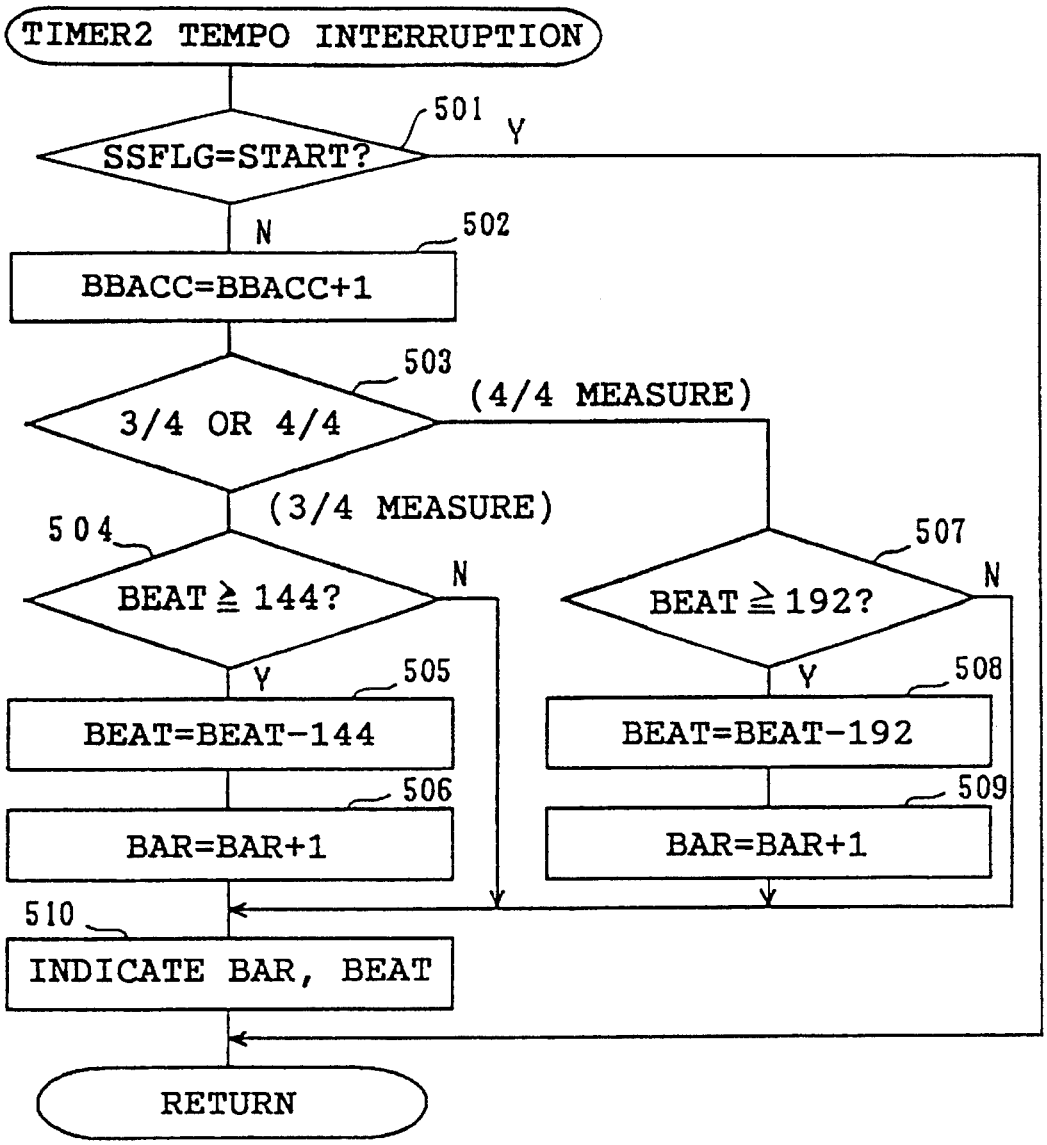
FIG. 17 is a flowchart showing the tempo interruption of TIMER2.
Figure 18:
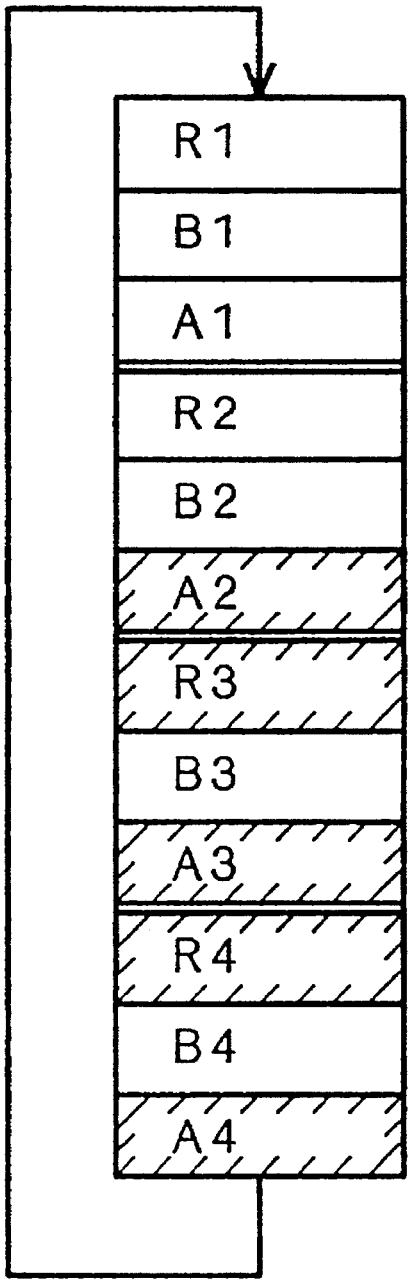
FIG. 18 PRIOR ART
FIG. 18 is an explanatory view of prior-art sequence tracks.

The routine of the interruption of INT2 from TIMER2 is now explained referring to the flowchart of FIG. 17. In the interruption routine the actual accompaniment speed is specified according to the set tempo speed. The routine arises when the presettable counter corresponding to the tempo speed of TIMER2 counts down to zero.

At step 501 it is determined whether or not flag S/S in bit 7 of start/stop flag memory SSFLG is one. If flag S/S equals one, at step 502 the value of accumulated bar number memory BBACC gains an increment of one. If flag S/S is not one, the routine ends.

At step 503 a 3/4 or 4/4 measure is determined. At the 3/4 measure, step goes to 504, and at the 4/4 measure, flow goes to step 507.

At the 3/4 measure it is determined at step 504 whether or not the number of beats equals or exceeds 144. If the number of beats equals or exceeds 144, at step 505 144 is subtracted from the number of beats, and at step 506 an increment of one is given to the number of bars.

At the 4/4 measure it is determined at step 507 whether or not the number of beats equals or exceeds 192. If the number of beats equals or exceeds 192, at step 508 192 is subtracted from the number of beats, and at step 509 an increment of one is given to the number of bars.

Subsequently, at step 510 the bar and beat numbers are converted and indicated in decimal form and the routine ends.

At steps 501 through 510 the processing for sound generation is successively executed according to the set tempo.

As aforementioned in the electronic organ of the preferred embodiment, even if the loop bar numbers stored in the rhythm, bass and arpeggio tracks are different from one another, the bar to be performed next for accompaniment can be determined by the remainder bar number resulting from dividing the accumulated bar number by the number of bars in each loop. Even if the rhythm style or track is changed during the accompaniment, the bar to be performed next can be determined quickly and easily. Therefore, the accompaniment continues smoothly.

In the preferred embodiment the minimum number of bars in the loop is stored in each track according to the rhythm style. Therefore, without deteriorating the accompaniment, the effective capacity of memory can be reduced.

The invention is not limited to the aforementioned embodiment. Within the scope of the invention various modifications are feasible.

For example, the method of determining the bar to be performed next is not limited to steps 216 and 244 of the preferred embodiment. The upper bits of the binary number of the bar counter shown in Table 1 can be masked.

Additionally, when the four bar loop is stored in rhythm track TR1, an AND operation is carried out using the present value of the bar counter stored in the accumulated bar number memory BBACC shown in FIG. 10A and Table 1 and the mask data corresponding to the four bar loop. The bar corresponding to the resulting logical product is set as the loop to be next performed. Based on the obtained bar, the present pointer T1PNT of rhythm track TR1 is set.

When the rhythm style or track is changed, through the masking of the value of the bar counter and the AND operation using the bar counter and the mask data, the bar to be next performed can be determined quickly and easily even if the number of bars in a loop is varied according to the rhythm style and track.

In the electronic organ of the preferred embodiment each of the rhythm, bass and arpeggio data, partly in common to plural chord type groups, can be stored in each sequence track. Such data is further provided with identifying information indicating which chord type group the data belongs to. Specifically, the data by which the bass or arpeggio data can be classified into the minor or major mode is also stored in the sequence track.

By detecting the chord type and determining the chord type group to which the detected chord type belongs, the accompaniment data corresponding to the selected chord type group can be selectively read out easily.

In the preferred embodiment, the rhythm, bass and arpeggio data are stored in TR1, TR2 and TR3, respectively. Thus, each of the accompaniment data can be stored in each sequence track and read out with one pointer, thereby reducing the memory in use. Even if the data having a different chord type group is entered by depressing the keys, the pointer can stay in the same track. Therefore, the processing of CPU1 is not wasted. Furthermore, the meaningless delay in performance can be avoided.

In the embodiment, as aforementioned, the rhythm data can be stored irrespective of the chord type group. Thus, the volume of memory can be reduced.

In the embodiment, chord types are classified into major and minor mode groups. Chord types, however, can be classified into major, minor, seventh and other chord group, easily.

What is claimed is:

1. An automatic performing system comprising:

a performance data memory for storing a plurality of performance data loops having different numbers of bars in different said performance data loops;

a loop performer, coupled to said performance data memory, for repeatedly reading at least one of the plurality of performance data loops stored in the performance data memory and performing a musical performance based upon the data in said at least one of the plurality of performance data loops;

a bar number counter electronically coupled to said loop performer for accumulating the number of bars performed from a beginning of the performance of the loop performer;

means, coupled to said loop performer, for switching said loop performer to a new data loop during a performance; and a reproduction indicator, when switching to a new data loop during a performance of the loop performer, for dividing the number of bars accumulated by the bar number counter with the number of bars looped in the new data loop and indicating the bar in the new data loop to be reproduced by the loop performer based on the remainder resulting from the division;

wherein the number of bars in each said loop is the number two raised to a power, which is a whole number, and the bar to be reproduced in the new data loop is indicated by masking specified bits of the accumulated bar number indicated in binary form.

2. An automatic performing system comprising;

a chord type detector for detecting a chord type in response to a depression of keys of a musical instrument;

a group identifying unit, coupled to said chord type detector, for identifying to which of a plurality of chord type groups the chord type detected by the chord type detector belongs to;

an accompaniment data memory, coupled to the chord type detector, for storing the detected chord types as accompaniment data corresponding to the detected chord types and for storing the accompaniment data of the same chord type group in one sequence track; and an accompaniment data reading unit, coupled to the accompaniment data memory, for selectively reading out the accompaniment data corresponding to the chord type group identified by the group identifying unit from the accompaniment data memory;

wherein, when at least two of the detected chord types have the same accompaniment data, the identifying unit indicates the accompaniment data in the at least two detected chord types that is the same and the accompaniment data memory stores the data that is the same in a single sequence track.

3. An automatic performing system provided in an electronic instrument for storing automatic performance patterns and reproducing the patterns based on a beat number corresponding to the tempo speed, said automatic performing system comprising:

a performance data memory for storing a plurality of performance data in which each of said plurality of data comprises:

a bar mark for the automatic performance pattern for indicating division of bars;

note data for the automatic performance pattern indicating the depressing or releasing of keys;

volume data for the automatic performance pattern indicating the volume of sound; and tone data for the automatic performance pattern indicating the tone; and a loop performer, coupled to said performance data memory, for repeatedly reading at least one of the plurality of performance data loops stored in the performance data memory and performing a musical performance based upon the data in the at least one of the plurality of performance data loops;

wherein said bar mark indicates the note data, the volume data and an event value of the corresponding bar, and said event value, during use, is stored in an area of memory occupied by said tone data and corresponds to an amount which is the total of the note data, the volume data and tone data in the corresponding bar combined.

4. An automatic performing system provided in an electronic instrument for storing automatic performance patterns and reproducing the patterns based on the beat number corresponding to tempo speed, said automatic performing system comprising:

a performance data memory for storing a plurality of performance data in which each of said plurality of data comprises:

a bar mark for the automatic performance pattern for indicating the division of bars;

note data for the automatic performance pattern indicating the depressing or releasing of keys;

volume data for the automatic performance pattern indicating the volume of sound; and tone data for the automatic performance pattern indicating the tone; and a loop performer, coupled to said performance data memory, for repeatedly reading at least one of the plurality of performance data loops stored in the performance data memory and performing a musical performance based upon the data in the at least one of the plurality of performance data loops;

wherein said bar mark, during use, indicates the volume data and tone data of the corresponding bar the moment the corresponding bar is initiated.

5. An automatic performing system provided in an electronic instrument for storing automatic performance patterns and reproducing the performance patterns based on a beat number corresponding to tempo speed, said automatic performing system comprising:

a performance data memory for storing a plurality of performance data, in which each of said plurality of data comprises:

a bar mark for the automatic performance pattern for indicating division of bars;

note data for the automatic performance pattern indicating depressing or releasing of keys;

volume data for the automatic performance pattern indicating the volume of sound;

tone data for the automatic performance pattern indicating the tone; and bend data for the automatic performance pattern indicating an automatic bend; and a loop performer, coupled to said performance data memory, for repeatedly reading at least one of the plurality of performance data loops stored in the performance data memory and performing a musical performance based upon the data in the at least one of the plurality of performance data loops;

wherein, during use, said bend data includes bend depth data indicating the depth of the automatic bend and bend release data indicating the time interval until the automatic bend is completed.

6. The automatic performing system according to claim 5, wherein said bend release data is represented as a function of a beat number corresponding to the beat of the performance.

* * * * *